US010976125B2

(12) United States Patent
Hood, II et al.

(10) Patent No.: US 10,976,125 B2
(45) Date of Patent: Apr. 13, 2021

(54) CROSS-PLATFORM SUPPRESSOR ASSEMBLY FOR A FIREARM

(71) Applicants: Jimmy Lee Hood, II, Santa Rosa Beach, FL (US); Kyle Grob, Kennesaw, GA (US)

(72) Inventors: Jimmy Lee Hood, II, Santa Rosa Beach, FL (US); Kyle Grob, Kennesaw, GA (US)

(73) Assignee: ELEVATED SILENCE, LLC, Santa Rosa Beach, FL (US)

( * ) Notice: Subject to any disclaimer, the term of this patent is extended or adjusted under 35 U.S.C. 154(b) by 0 days.

(21) Appl. No.: 16/749,431

(22) Filed: Jan. 22, 2020

(65) Prior Publication Data

US 2020/0232741 A1 Jul. 23, 2020

Related U.S. Application Data

(60) Provisional application No. 62/795,396, filed on Jan. 22, 2019.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/34; F41A 21/36
USPC ..... 89/14.4, 14.2; 181/223
See application file for complete search history.

(56) References Cited

U.S. PATENT DOCUMENTS

| | | | | |
|---|---|---|---|---|
| 1,017,003 | A * | 2/1912 | Kenney | F41A 21/30 181/223 |
| 6,575,074 | B1 † | 6/2003 | Gaddini | |
| 7,308,967 | B1 † | 12/2007 | Hoel | |
| 7,594,464 | B2 * | 9/2009 | Dueck | F41A 21/30 89/14.2 |
| 8,511,425 | B2 † | 8/2013 | Larue | |
| 8,978,818 | B2 † | 3/2015 | Proske | |
| 9,476,661 | B2 † | 10/2016 | Troy | |
| 9,513,078 | B1 * | 12/2016 | Fulton | F41A 21/30 |
| 9,709,354 | B2 * | 7/2017 | Larue | F41A 21/30 |
| 10,228,210 | B2 † | 3/2019 | Parker | |
| 10,480,888 | B2 † | 11/2019 | Barrett | |

* cited by examiner
† cited by third party

*Primary Examiner* — Reginald S Tillman, Jr.
(74) *Attorney, Agent, or Firm* — Eversheds Sutherland (US) LLP

(57) ABSTRACT

A suppressor assembly can include an external can having first and second ends. A muzzle brake can be positioned along the first end and configured to be coupled to a firearm. The assembly can include a first expansion chamber and a second expansion chamber disposed within the tubular body with a portion of the muzzle brake extending through the first and second expansion chambers. The muzzle brake can include a first muzzle chamber fluidicly coupled to the first expansion chamber and a second muzzle chamber fluidicly coupled to the second expansion chamber. Multiple baffles can be positioned within the external can between the first expansion chamber and the second end of the external can, including first and second baffle sets that each include a first baffle and a second baffle. The assembly can also include an endcap coupled to the second end of the external can.

20 Claims, 20 Drawing Sheets

CROSS-PLATFORM SUPPRESSOR ASSEMBLY FOR A FIREARM

RELATED APPLICATIONS

This application claims priority under 35 U.S.C. § 119 to U.S. Provisional Patent Application No. 62/795,396 filed Jan. 22, 2019, and titled "CROSS-PLATFORM SUPPRESSOR ASSEMBLY," the entire contents of which are hereby incorporated herein by reference for all purposes.

TECHNICAL FIELD

The disclosure generally relates to a suppressor for a firearm, and more particularly to a multi-stack suppressor configured to adapt to multiple firearm platforms.

BACKGROUND

A firearm creates a loud audible noise and a flash as a round is discharged from within the firearm. Generally, a suppressor is coupled to the muzzle end of a firearm barrel. Suppressors work to reduce the audible discharge of a firearm as well as decrease the muzzle flash. The noise and light created by the discharge may be reduced in a number of different ways depending on the design of the suppressor. Conventional suppressors include a series of expansion chambers that capture and/or redirect the gas and sound-waves expelled from the firearm barrel. Some conventional suppressors simply place multiple walls and chambers throughout the suppressor in an effort to effect the way that exhaust is discharged from the firearm through the suppressor. In addition, some conventional suppressors claim to be configured to be used with different caliber ammunition, but these conventional suppressors do nothing to adjust with the use of different caliber ammunition except have a bore large enough to accommodate each of the different caliber projectiles discharging from the firearm.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
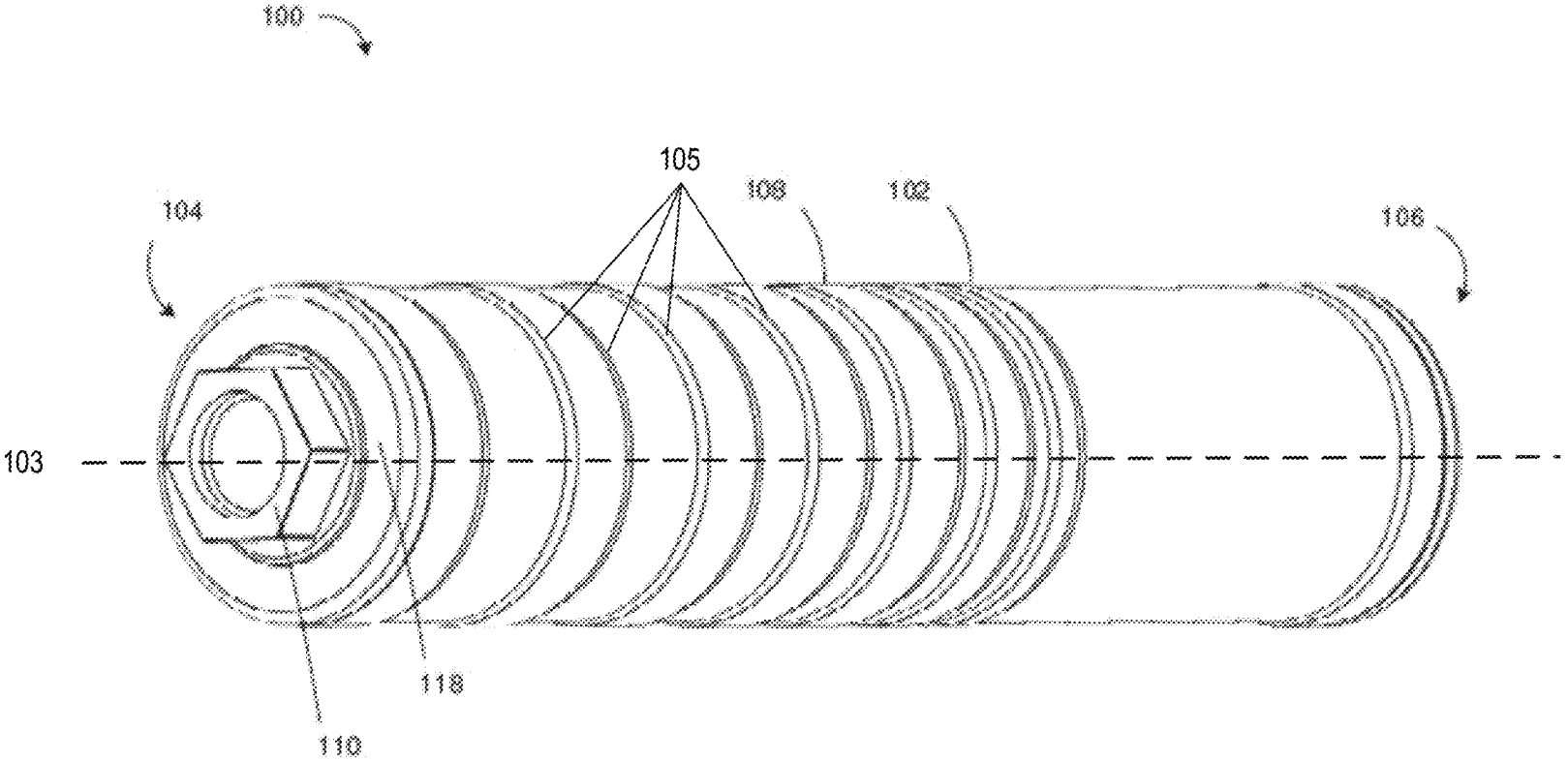
FIG. 1 depicts a front perspective view of a cross-platform assembly for a suppressor in accordance with one or more embodiments of the disclosure.
Figure 2:
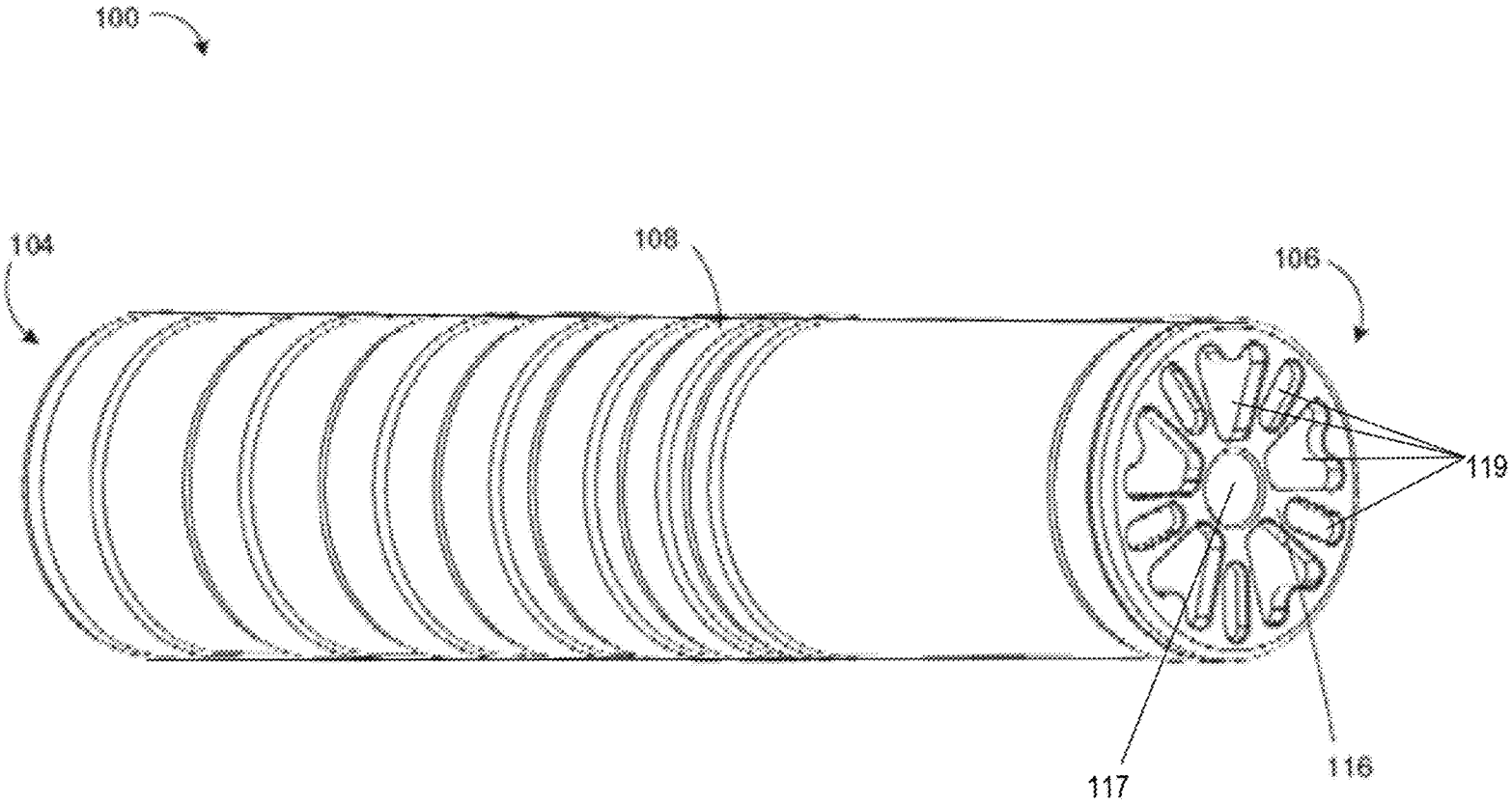
FIG. 2 depicts a rear perspective view of the cross-platform assembly for the suppressor of FIG. 1 in accordance with one or more embodiments of the disclosure.
Figure 3:
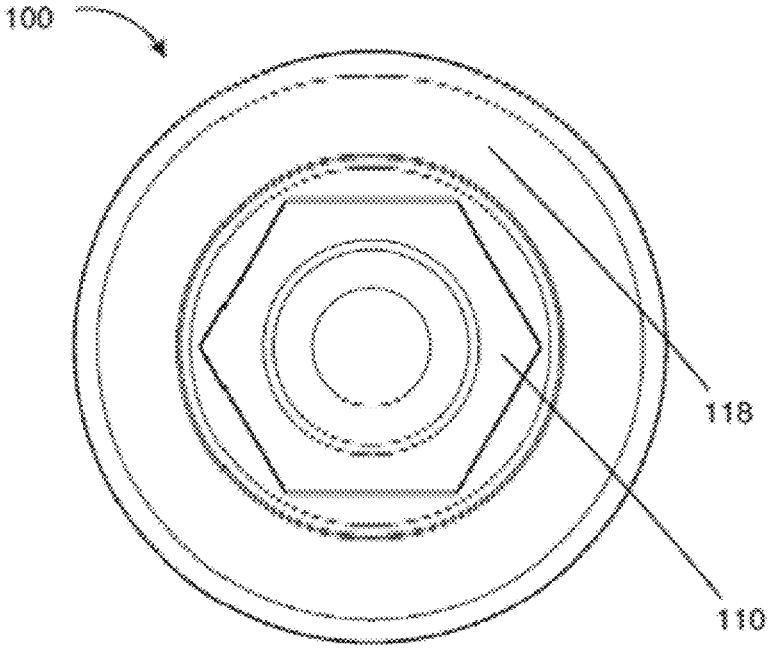
FIG. 3 depicts a front elevation view of the cross-platform assembly for the suppressor of FIG. 1 in accordance with one or more embodiments of the disclosure.
Figure 4:
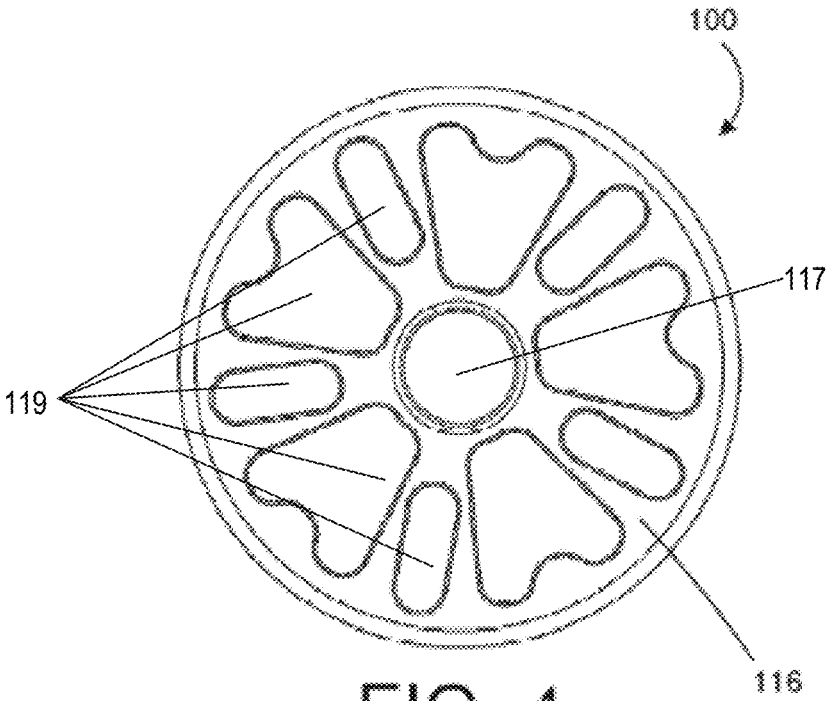
FIG. 4 depicts a rear elevation view of the cross-platform assembly for the suppressor of FIG. 1 in accordance with one or more embodiments of the disclosure.
Figure 5:
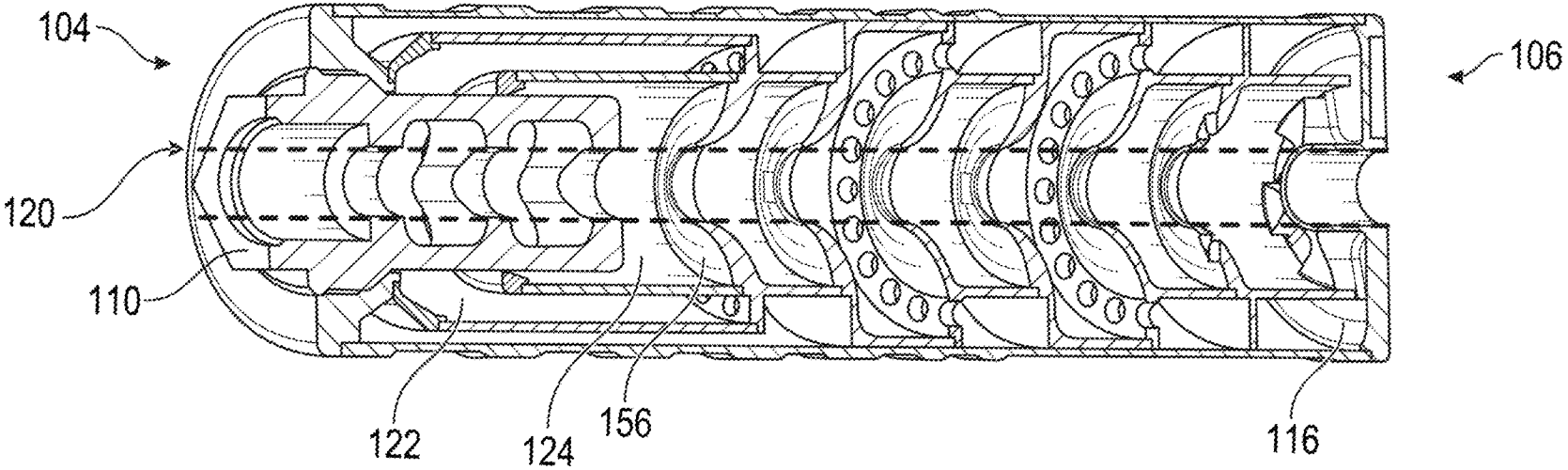
FIG. 5 depicts a cross-sectional, perspective view of the cross-platform assembly for the suppressor of FIG. 1 in accordance with one or more embodiments of the disclosure.
Figure 6:
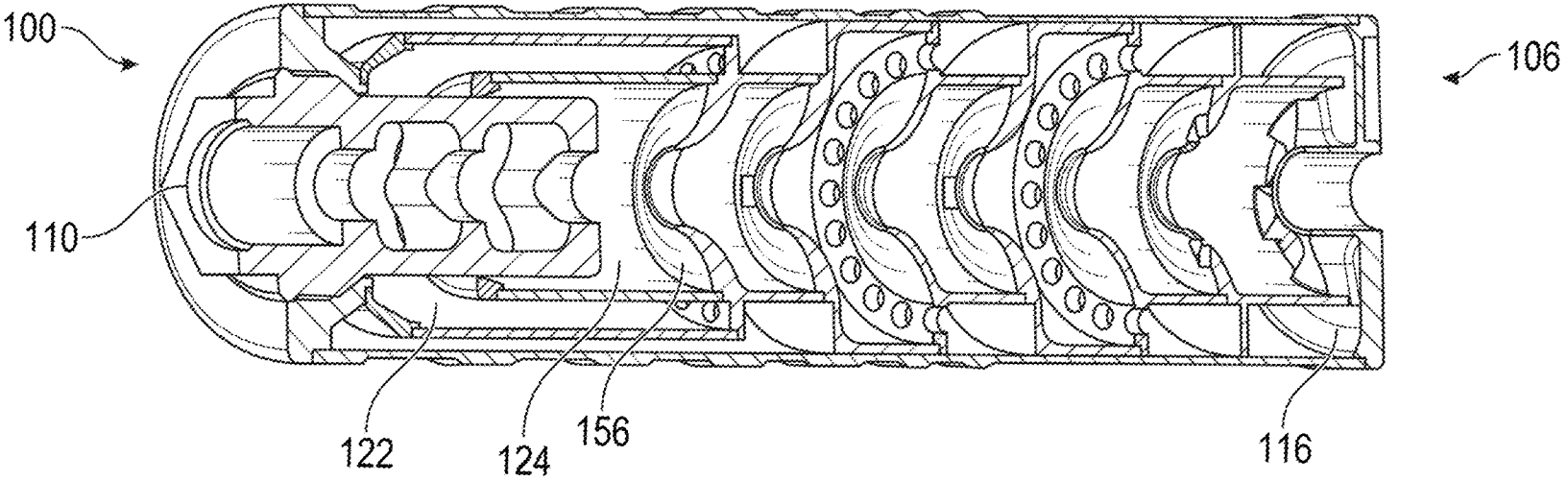
FIG. 6 depicts a cross-sectional, perspective view of the cross-platform assembly for the suppressor of FIG. 1 in accordance with one or more embodiments of the disclosure.

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Certain relationships between features of the suppressor are described herein using the term "substantially" or "substantially equal". As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

Embodiments of the present disclosure relate generally to a cross-platform suppressor for a firearm that can be configured to operably attach to one or more than one type of muzzle brake on different firearms. In certain examples, a suppressor can include a muzzle brake that diverts exhaust generated from the firing of a projectile from the firearm muzzle into multiple, separate expansion chambers and dead chambers. That is, as a projectile travels through the bore (e.g., an extended aligned aperture) in the suppressor, the exhaust gas diverts into different chambers of the suppressor. In this manner, the suppressor causes the exhaust gas to lose velocity and pressure from the projectile's path through the bore.

For example, in a first zone of the cross-platform suppressor, as the projectile enters a first muzzle chamber, the exhaust gas is diverted generally perpendicularly to the projectile's path from the bore through the suppressor into a first expansion chamber. The gas may then circulate into a dead chamber disposed around at least a portion of the first expansion chamber. As the projectile enters the second muzzle chamber, the exhaust gas can be diverted perpendicularly from the bore into a second expansion chamber.

Further to this example, in a second zone, the projectile can pass through multiple baffles. In one example, the multiple baffles may include a first set of baffles and a second set of baffles. Each set of baffles may include a first baffle with a solid, continuous flange and a second baffle with a multitude of apertures in the area of the flange. In this manner, as the projectile enters each baffle set, the exhaust gas discharges through the apertures of the second baffle and into at least one exhaust duct fluidicly coupled to the one or more apertures.

In certain example embodiments, the suppressor assembly can also include an external can or housing. In certain examples, the external can may have a cylindrical or generally cylindrical shape and a tubular body that defines a channel or passageway extending from one end of the external can to the opposing end. In other instances, the external can may have another cross-section, including rectangular, triangular, or other shape. In other instances, the external can may include a one or more ledges disposed therein. The channel or passageway can be configured to receive, for example, multiple baffles, a muzzle brake, and multiple endcaps (e.g., an endcap, a muzzle brake cap). In some instances, external can may be a continuous, hollow cylindrical shape from the proximate end and the distal end.

In certain example embodiments, the suppressor assembly may also include a muzzle brake cap and an endcap. For example, the muzzle brake cap may be disposed on the proximate end (or end that is attached to the firearm) and the endcap may be disposed on the distal end (or free end of the suppressor assembly when attached to a firearm). As referred to herein, the proximate end and the distal end may be interchangeable. The muzzle brake cap may be a cylindrical or substantially cylindrical shim that is configured to receive a muzzle brake as described herein. For example, the muzzle brake cap may include a threaded interior surface about which the muzzle brake is threadably coupled thereto. In some example embodiments, multiple muzzle brakes may be adapted to fit within the muzzle brake cap. In one example, the muzzle brake cap can be coupled to the external can by threadably coupling, welding, adhesives, cementing, fusing, or some other coupling method. In certain example embodiments, the endcap may be disposed on the opposing end (e.g., distal end) to the muzzle brake cap. The endcap can include one or more raised semi-circular walls, with each wall configured to channel exhaust gas into a dead chamber exhaust duct with a baffle as described herein.

In certain example embodiments, the suppressor assembly may also include a muzzle brake configured to be operably coupled to the external can. The muzzle brake may be disposed on the proximate end (or end that is attached to the firearm) of the suppressor assembly. In one example, the muzzle brake may include a bore that extends through the muzzle brake from one end of the muzzle brake to a distal second end of muzzle brake. In some examples, the muzzle brake may also include a first muzzle chamber and a second muzzle chamber that each extend in a direction parallel, substantially parallel, perpendicular or substantially perpendicular to the bore. Each muzzle chamber can define an opening or cavity within the muzzle brake and may be disposed adjacent to one another. In other examples, the muzzle brake may include no muzzle chambers, one muzzle chamber, or more than two muzzle chambers. Each muzzle chambers can include a fore end and an aft end. A knub can be disposed on the aft end of the muzzle chamber and can be a raised portion or protrusion from a surface wall of the muzzle chamber that is configured to divert exhaust gas across the aft end and the bore centered through the knub. In this manner, as the projectile passes through the bore of the muzzle brake, the exhaust gas discharges across the knub. The exhaust gas rolls across the continuous surface of the expansion chamber (e.g., the first expansion chamber) as opposed to an edged surface that may unintentionally trap the exhaust gas into pockets. In some example embodiments, the muzzle brake chambers may have a square or substantially square cross-sectional surface area. In other examples, the muzzle brake chambers may be some other shape, such as triangular, rectangular, circular, or oval. In certain example embodiments, the muzzle brake may be configured to attach to 0.17 HMR to 0.300 Win Magnum calibers. In other examples, the muzzle brake may be configured to attach to larger or smaller calibers than the aforementioned.

In certain example embodiments, the suppressor assembly may also include a first expansion chamber. The first expansion chamber may include a wall defining a hollow cylindrical or substantially cylindrical body with an inner passageway or channel that extends through the first expansion chamber from a first end to a distal second end of the cylindrical body. In other instances, the first expansion chamber may have another cross-sectional geometric shape, such as rectangular or triangular. In certain examples, a shim can be coupled to the cylindrical body. The first expansion chamber may be disposed about all or at least a portion of muzzle brake and can abut a baffle included as part of the multitude of baffles.

In some examples, the passageway or channel of the first expansion chamber is fluidicly coupled with the first muzzle chamber of the muzzle brake. In this manner, as the projectile passes through the bore of the muzzle brake first muzzle chamber, the exhaust gas may be discharged from the muzzle chamber into the passageway or channel of the first expansion chamber. The exhaust gas disposed within the channel of the first expansion chamber may fluidicly pass through the first expansion chamber to be discharge through one or more apertures disposed through a flange of the baffle the first expansion chamber abuts. The exhaust gas may discharge through the apertures in the baffle and into a first dead chamber exhaust duct fluidicly coupled to the one or more apertures. In one example, the dead chamber exhaust duct may be a hollow space disposed between the external can and the outer wall of the first expansion chamber. In some examples, the only manner of ingress or egress for exhaust gas for the first dead chamber exhaust duct is through the apertures disposed through the baffle flange. In other examples, the exhaust gas may escape through apertures in the external can and/or other apertures within other components described herein.

In certain example embodiments, the suppressor assembly may also include a second expansion chamber. The second expansion chamber may include a wall defining a hollow cylindrical or substantially cylindrical body with an inner passageway or channel that extends through the second expansion chamber from a first end to a distal second end of the cylindrical body. In other instances, the second expansion chamber may have another cross-sectional geometric shape, such as rectangular or triangular. In certain examples, a shim can be coupled to the cylindrical body. The second expansion chamber may be disposed about all or at least a portion of the muzzle brake and can abut a baffle included within the multitude of baffles. in certain examples, the channel of the second expansion chamber has a diameter that is greater than the diameter of the muzzle brake such that muzzle brake can be inserted into the channel of the second expansion chamber. As the body of the second expansion chamber expands from heat, the diameter of the channel may change such that the body of the second expansion chamber may tighten onto the muzzle brake. In some examples, the channel of the second expansion chamber may be fluidicly coupled with the second muzzle chamber of the muzzle brake. In this manner, as the projectile passes through the bore of the muzzle brake along the second muzzle chamber, the exhaust gas may be discharged from the second muzzle chamber into the channel of the second expansion chamber. In certain embodiments, the exhaust gas may only escape from the second expansion chamber either through a vacuum exerted on the second expansion chamber as the pressure throughout the suppressor assembly works to achieve equilibrium.

In certain example embodiments, the suppressor assembly may also include a multitude of baffles. For example, the multiple baffles may include a first baffle set, a second baffle set, an endcap baffle, and an expansion chamber baffle. In some examples, the multitude of baffles may be disposed adjacent to one another in series in a baffle stack. In other examples, the multitude of baffles may be disposed between other components described herein or one or more other components described herein may be positioned between two baffles included within the baffle stack.

In certain example embodiments, the expansion chamber baffle is disposed adjacent to and abuts the first expansion chamber and the second expansion chamber within the channel of the external can. For example, the expansion chamber baffle may include a first wall that extends axially from a first end of the expansion chamber baffle and has a cylindrical or substantially cylindrical shape. The expansion chamber baffle can also include an arcuate surface disposed along the distal second end of the expansion chamber baffle. The arcuate surface may be disposed about a center axis of the expansion chamber baffle and positioned adjacent to or within the first expansion chamber and/or the second expansion chamber. In some examples, the expansion chamber baffle may also include a first seat and a second seat disposed about the arcuate surface. For example, the expansion chamber baffle may also include a flange that extends radially outward and can be positioned between the arcuate surface and the first wall of the expansion chamber baffle. The first side of the flange adjacent to the arcuate surface may include a first flange wall having a first circumference. The second side of the flange may include an second flange wall having a second circumference that is greater than the first circumference. The first flange wall may include a first seat. In some examples, the first seat may be an outer edge (e.g., two flat surfaces creating a 90-degree angle or some other angle) of the first flange wall adjacent to the arcuate surface. The second flange wall may include a second seat. In some examples, the second seat may be an outer edge on the second flange wall. The first seat may be configured to engage and abut an inner wall of the second expansion chamber and the second seat may be configured to engage and abut an inner wall of the first expansion chamber. The flange can also include one or multiple apertures that extend axially or substantially axially through the flange and are positioned radially between the first flange wall and the second flange wall.

In certain example embodiments, each baffle set of the multitude of baffles may include a first baffle and a second baffle. The first baffle and the second baffle may each include a first wall that extends axially from a first end of the particular baffle and has a cylindrical or substantially cylindrical shape. Each of the first baffle and the second baffle can also include an arcuate surface disposed along the distal second end of the particular baffle. The arcuate surface may be disposed about a center axis of the particular baffle. In some examples, an aperture may be disposed through arcuate surface and can be fluidicly coupled to a passageway or channel defined by the first wall. Each of the first baffle and second baffle can also include a flanged surface that is positioned adjacent to one end of the arcuate surface, extends about a perimeter of the arcuate surface, and extends radially or substantially radially outward from the end of the arcuate surface. The flanged surface for the first baffle may be solid and not include any apertures disposed through the flange surface. The flanged surface for the second baffle can include one or multiple apertures that extend axially or substantially axially through the flange surface and are positioned radially between the arcuate surface and the outer edge of the flange surface. In other embodiments, each baffle may include a continuous, solid surface or each baffle may include one or multiple apertures that extend axially or substantially axially through the flange surface and are positioned radially between the arcuate surface and the outer edge of the flange surface. In some examples, the first baffle set and the second baffle set may be axially aligned and/or abut within the channel of the external can. The first baffle set and the second baffle set may also include at least one exhaust duct disposed between the second baffle of the first baffle set and the first baffle of the second baffle set. In certain examples, the at least one exhaust duct is fluidicly coupled to the one or multiple apertures that axially extend through the flanged surface of the second baffle. In this configuration, as the projectile passes through the first baffle, the exhaust gas may impact along an arcuate surface of the second baffle, and progress through one or more of the apertures disposed through the flange of the second baffle, and further progresses into the at least one exhaust duct fluidicly coupled thereto.

In certain example embodiments, the endcap baffle may include an arcuate surface along a first end and a seat on or adjacent to an arcuate surface to receive the second baffle in an aforementioned baffle set. The endcap baffle can also include a first wall that extends axially from a second end of the endcap baffle and has a cylindrical or substantially cylindrical shape. The first wall of the endcap baffle may abut a seat on the endcap along the second end, thereby securing the endcap baffle between the endcap and the baffle set. A flanged surface may be positioned along an end of or adjacent to the arcuate surface, can surround the arcuate surface, and can extend radially outward therefrom. In certain embodiments, the flanged surface may be continuously solid about the arcuate surface. In other examples, one or multiple apertures that extend axially or substantially axially through the flanged surface and can be positioned radially between the arcuate surface and an outer perimeter of the flanged surface. In certain embodiments, the external can, the endcap, the solid surface of the endcap baffle, and the first wall of the endcap baffle may define a second dead chamber exhaust duct within the external can that is fluidicly coupled to the one or multiple apertures of the endcap baffle. Accordingly, as the projectile passes through the endcap baffle, the exhaust gas may progress into an endcap channel disposed between the endcap baffle and the endcap. The endcap channel may cause the exhaust gas to progress into the second dead chamber exhaust duct. In some instances, the exhaust gas within the second dead chamber exhaust duct may escape from within the second dead chamber exhaust duct when a vacuum is applied therein or the external can adjusts to equilibrium.

Figure 7:
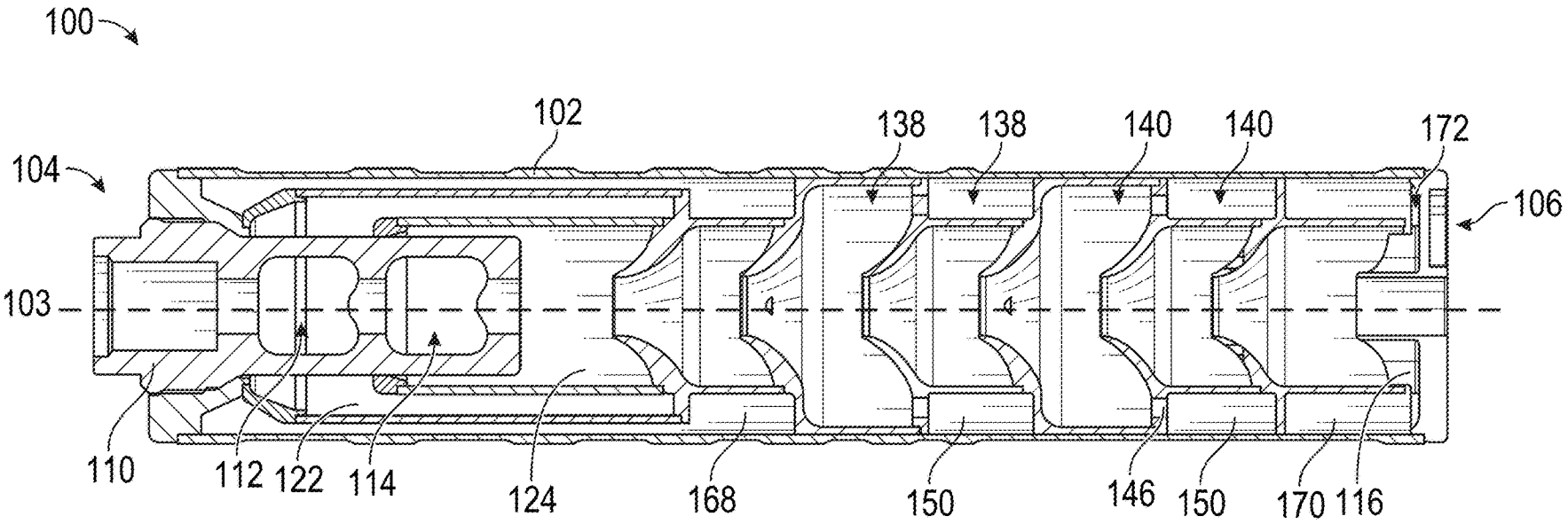
FIG. 7 depicts a cross-sectional view of the cross-platform assembly for the suppressor of FIG. 1 in accordance with one or more embodiments of the disclosure.
Figure 8:
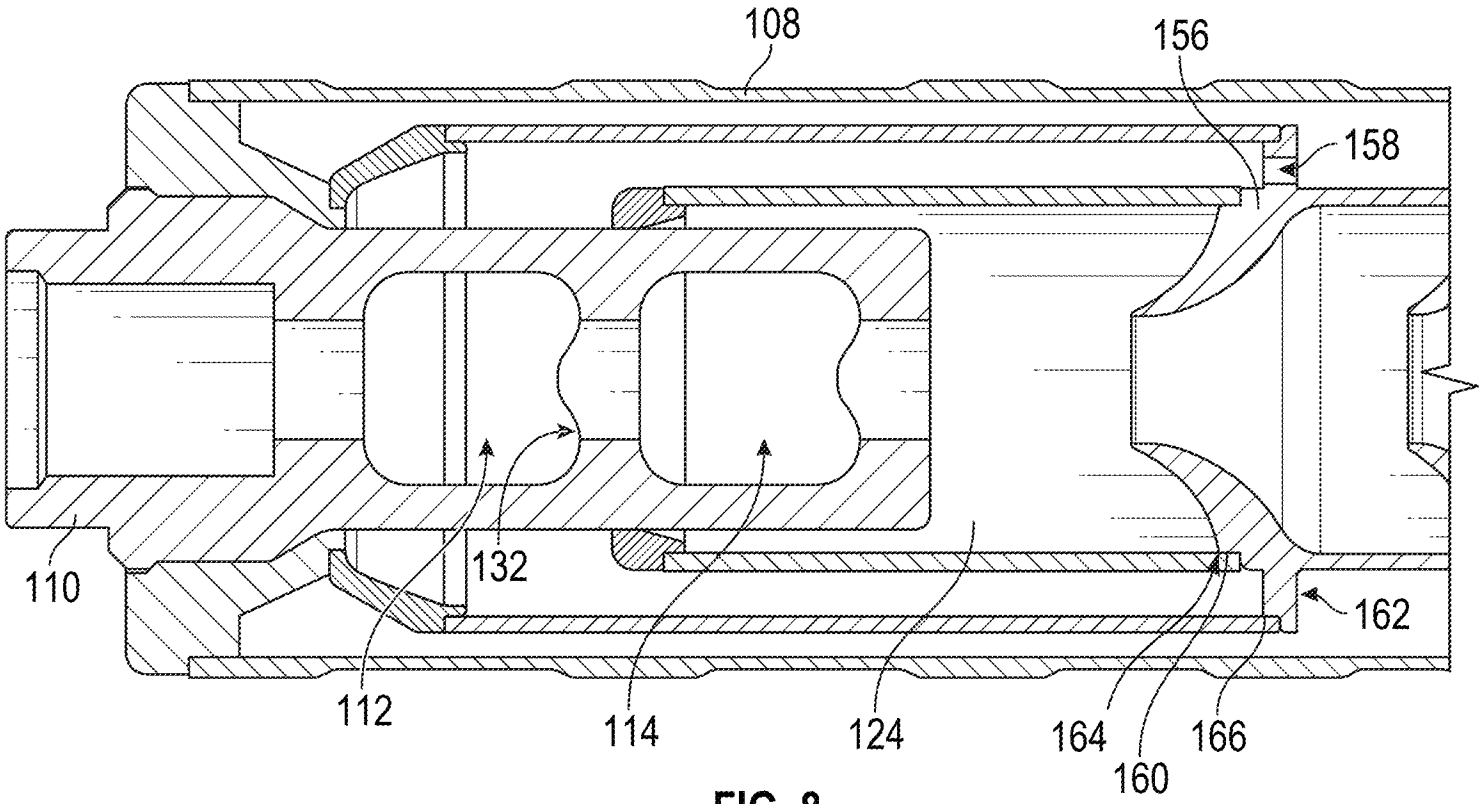
FIG. 8 depicts a partial cross-sectional view of the cross-platform assembly for the suppressor of FIG. 1 in accordance with one or more embodiments of the disclosure.
Figure 9:
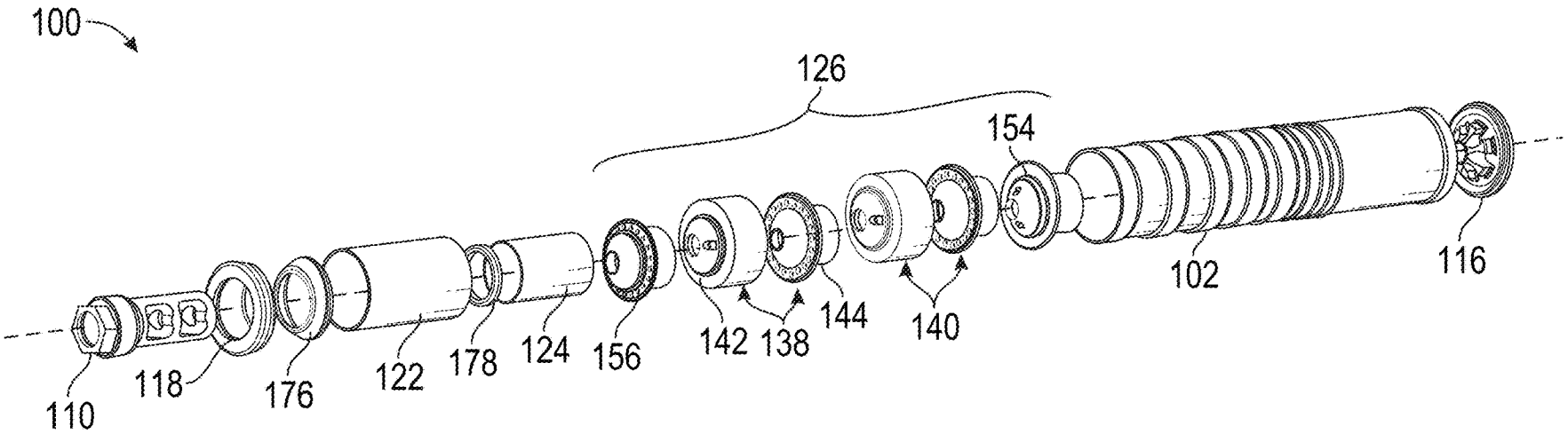
FIG. 9 depicts an exploded view of the cross-platform assembly for the suppressor of FIG. 1 in accordance with one or more embodiments of the disclosure.
Figure 10A:
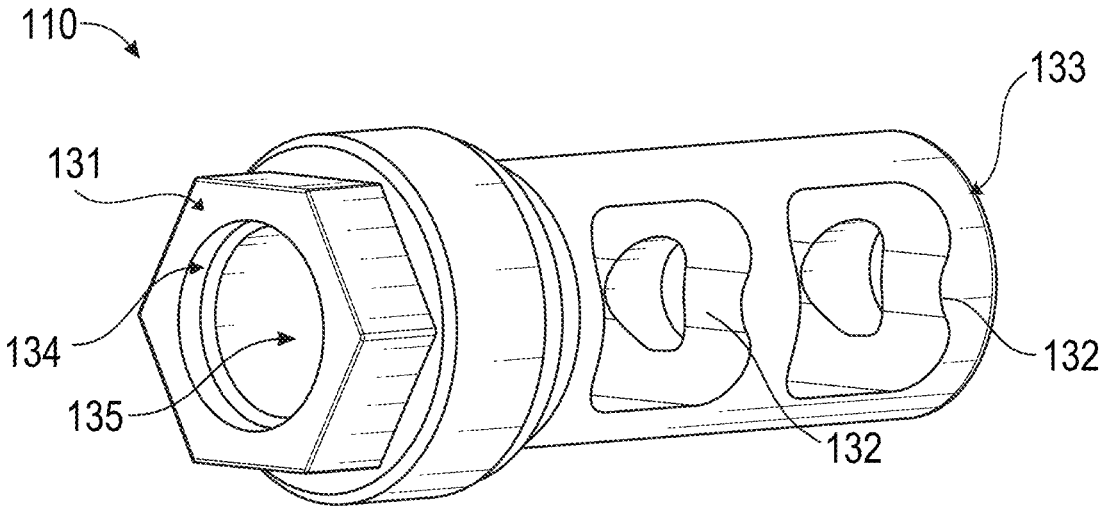
FIG. 10A depicts a front perspective view of a muzzle brake for use in the suppressor of FIG. 1 in accordance with one or more embodiments of the disclosure.
Figure 10B:
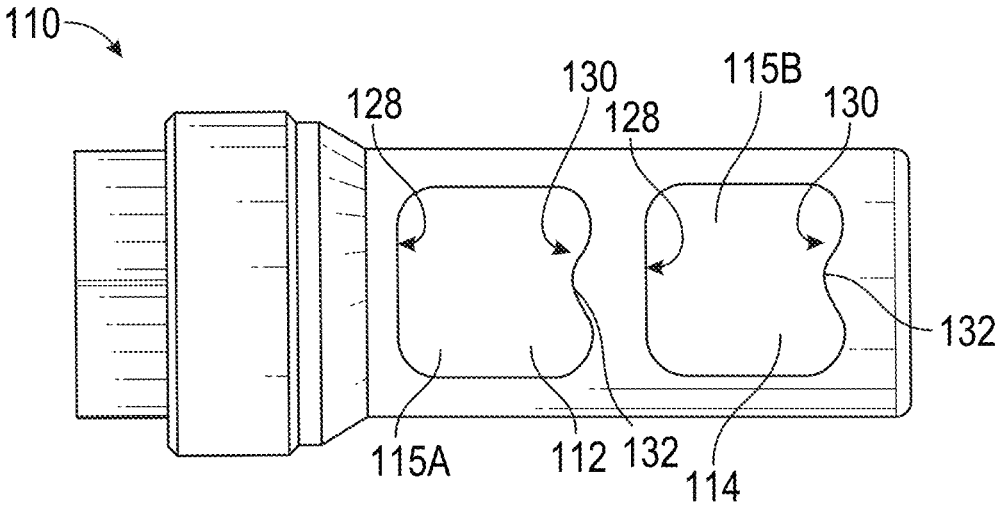
FIG. 10B depicts a side elevation view of the muzzle brake for use in the suppressor of FIG. 1 in accordance with one or more embodiments of the disclosure.
Figure 10C:
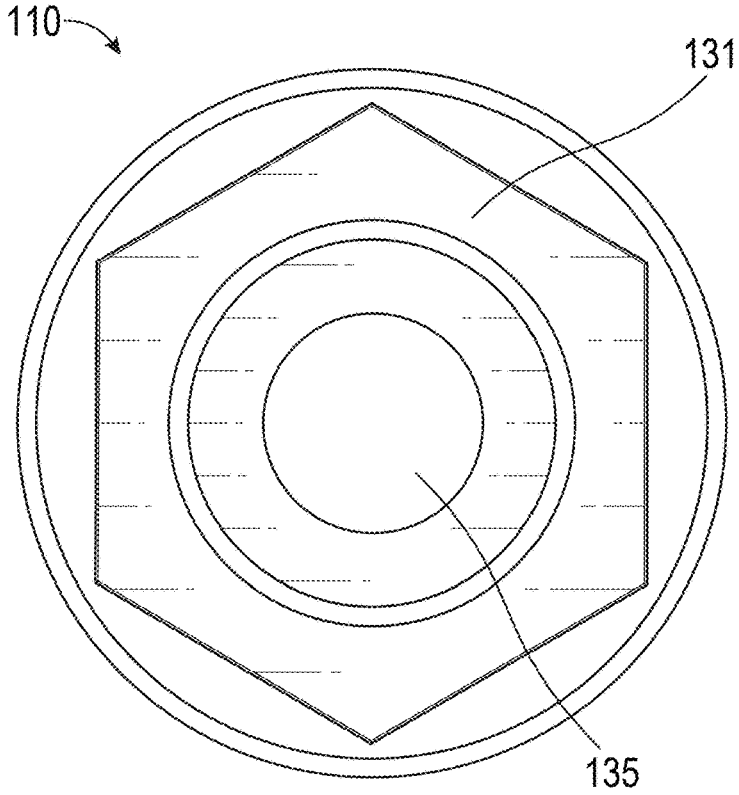
FIG. 10C depicts a front elevation view of the muzzle brake for use in the suppressor of FIG. 1 in accordance with one or more embodiments of the disclosure.
Figure 10D:
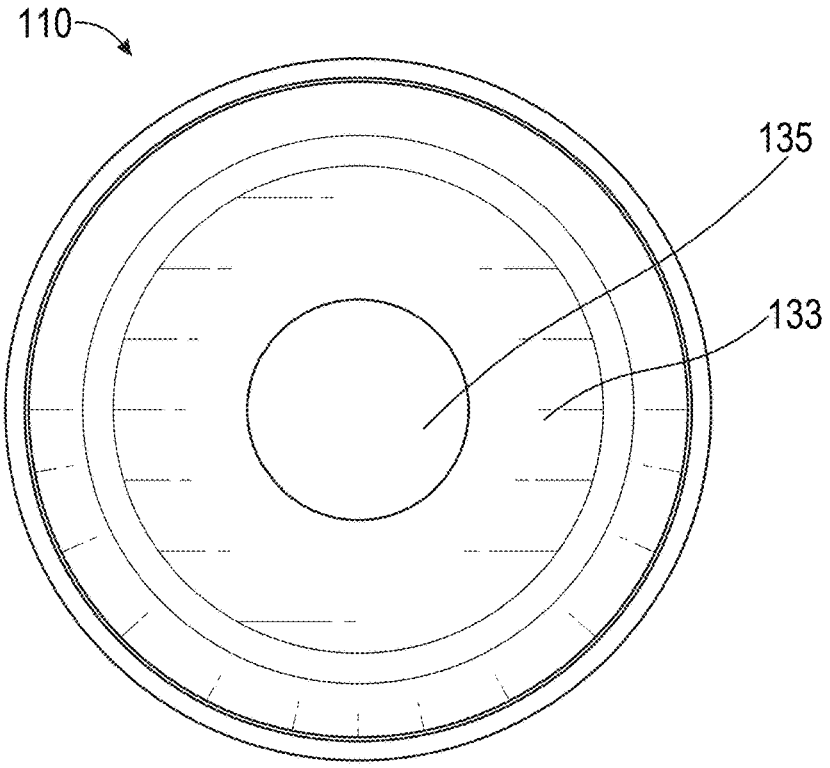
FIG. 10D depicts a rear elevation view of the muzzle brake for use in the suppressor of FIG. 1 in accordance with one or more embodiments of the disclosure.

FIGS. 1-4 depict front and rear perspective and elevation views of a cross-platform suppressor assembly 100 in accordance with one or more embodiments of the disclosure. FIGS. 5-8 are full or partial cross-sectional views of the suppressor assembly 100 of FIG. 1 in accordance with one or more embodiments of the disclosure. FIG. 9 is an exploded view of the suppressor assembly 100 of FIG. 1 in accordance with one or more embodiments of the disclosure. Referring now to FIGS. 1-9, the suppressor assembly 100 can include an outer housing 108 with a first end 104 and a distal second end 106. In some examples, the outer housing 108 of the suppressor assembly 100 includes an external can 102 that extends from or substantially from the first end 104 to the second end 106. In one example, the external can 102 can include a wall having an inner surface and an outer surface. The inner surface of the wall can define a passageway or channel that extends axially through the external can 102 along its longitudinal axis 103 from the first end 104 to the second end 106. In certain examples, the external can 102 has a cylindrical or substantially cylindrical shape. Further, the external can 102 can be substantially hollow such that the can channel makes up a substantial portion of the diameter of the external can 102. In other examples, the external can 102 can have a cuboid or any other shape. In some examples, the external can 102 includes one or more circumferential grooves 105 in the outer surface of the wall of the external can 102. Each of the one or more grooves 105 can be orthogonal to the longitudinal axis 103 of the external can 102 and may be axially separated along the longitudinal axis.

Figure 11A:
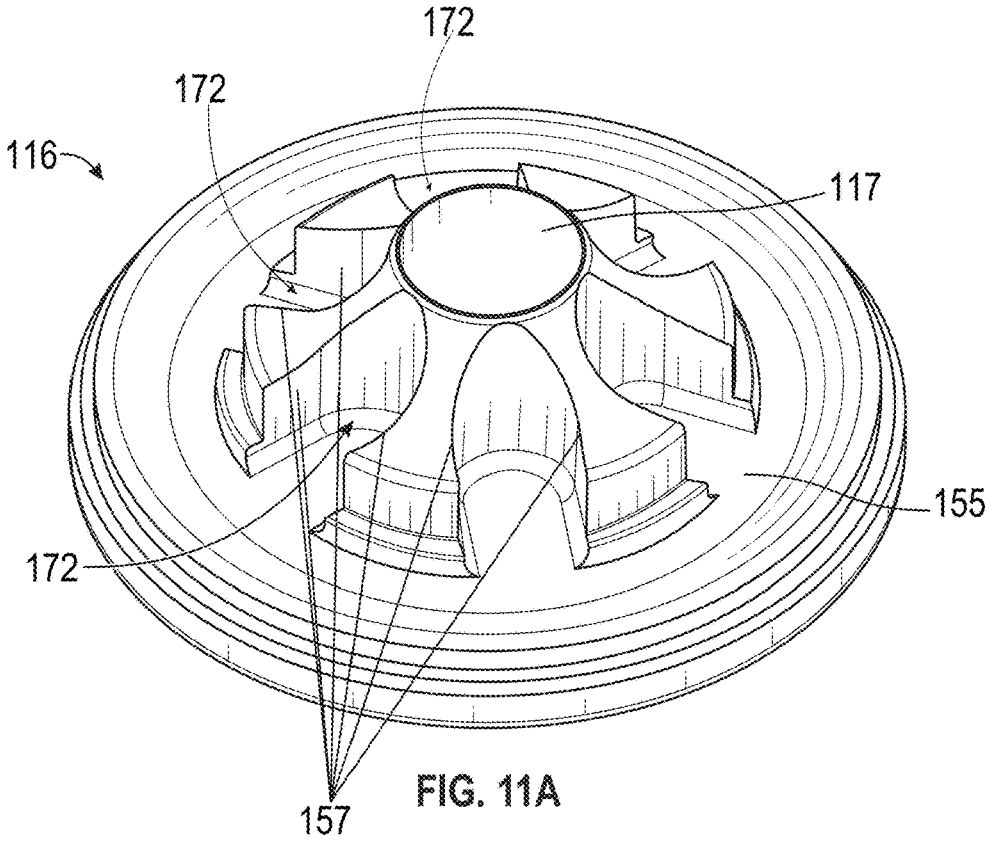
FIG. 11A depicts a perspective view of an endcap for use in the suppressor of FIG. 1 in accordance with one or more embodiments of the disclosure.
Figure 11B:
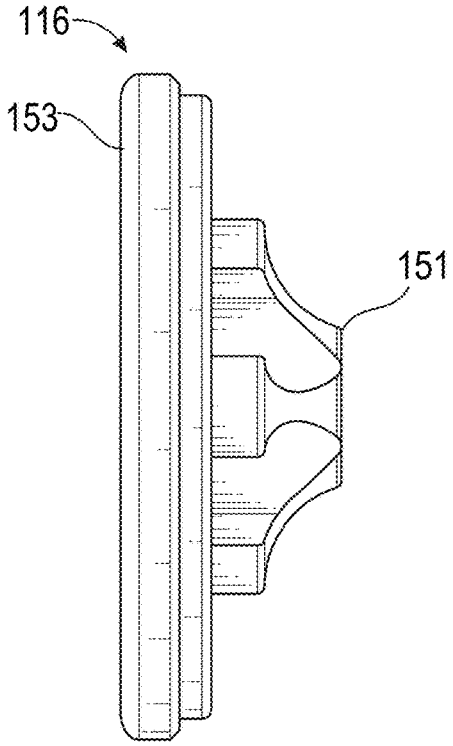
FIG. 11B depicts a side elevation view of the endcap for use in the suppressor of FIG. 1 in accordance with one or more embodiments of the disclosure.
Figure 11C:
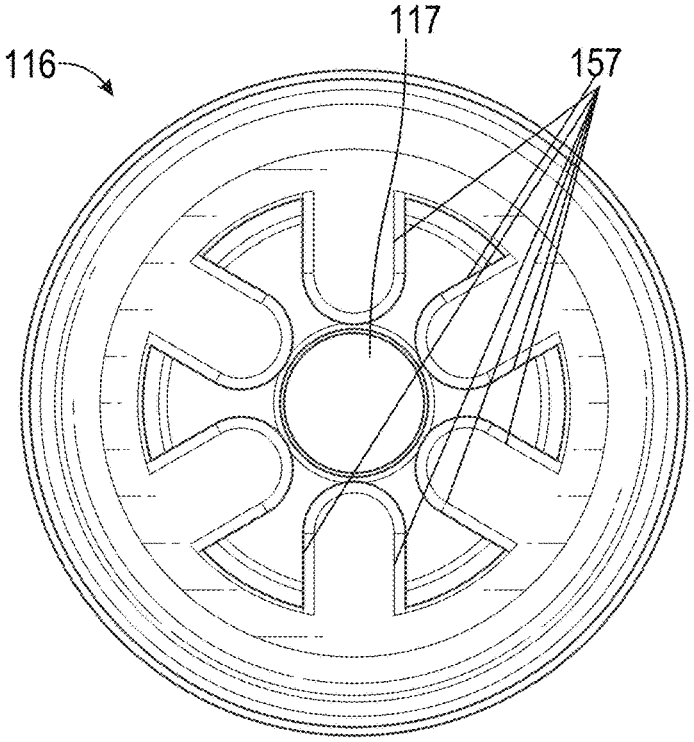
FIG. 11C depicts a top elevation view of the endcap for use in the suppressor of FIG. 1 in accordance with one or more embodiments of the disclosure.

In certain example embodiments, the suppressor assembly 100 can also include an endcap 116 coupled to the external can 102 and disposed on the second end 106 of the outer housing 108. FIGS. 11A-C depict various views of an endcap 116 for the suppressor assembly 100 in accordance with one or more embodiments of the disclosure. Referring to FIGS. 1-9 and 11A-C, the example endcap 116 can include a first end 151, a distal second end 153, and a channel or passageway 117 that extends through the endcap 116 from the first end 151 to the second end 153 in an axial direction and through which a projectile may travel. In certain examples, the diameter of the channel 117 is less than the diameter of the passageway or channel of the external can 102. The channel 117 can be axially aligned with the bore 120 along the longitudinal axis 103 and configured to align with the bore of a firearm when the suppressor assembly 100 is coupled to a firearm. In some examples, the endcap 116 may also include additional indentations and/or apertures 119 (see FIG. 2) that extend through the body of the endcap 116. These indentations and/or apertures 119 in the body of the endcap 116 may be provided to reduce the weight of the endcap 116, provide additional pathways for the dispersing of exhaust gasses from the firearm, and/or provide an aesthetic benefit to the endcap 116 and/or suppressor assembly 100.

In some examples, the endcap 116 may also include one or more endcap channels 172 provided along an interior facing surface 155 of the trailing end of the endcap 116. Each endcap channel 172 can be axially aligned with a dead chamber exhaust duct 168,170 (e.g., as shown in FIG. 7) and configured to direct exhaust gas that impacts the interior facing surface 155 of the endcap 116 into the second dead chamber exhaust duct 170. Each endcap channel 172 can be defined by one or more outwardly projecting walls 157 extending axially out from (e.g., away from) the interior facing surface 155 of the endcap 116. The walls 157 and channels 172 can have any number of shapes and sizes.

The suppressor assembly 100 can also include a bore 120 (identified by the pair of dashed lines in FIG. 5) or channel that extends through the entirety of the suppressor assembly 100 from the first end 104 to the second end 106 of the outer housing 108. In certain examples, the bore 120 is less than the diameter of the passageway or channel of the external can 102. The bore 120 can be configured to align with the bore of a firearm when the suppressor assembly 100 is coupled to a firearm.

Figure 18A:
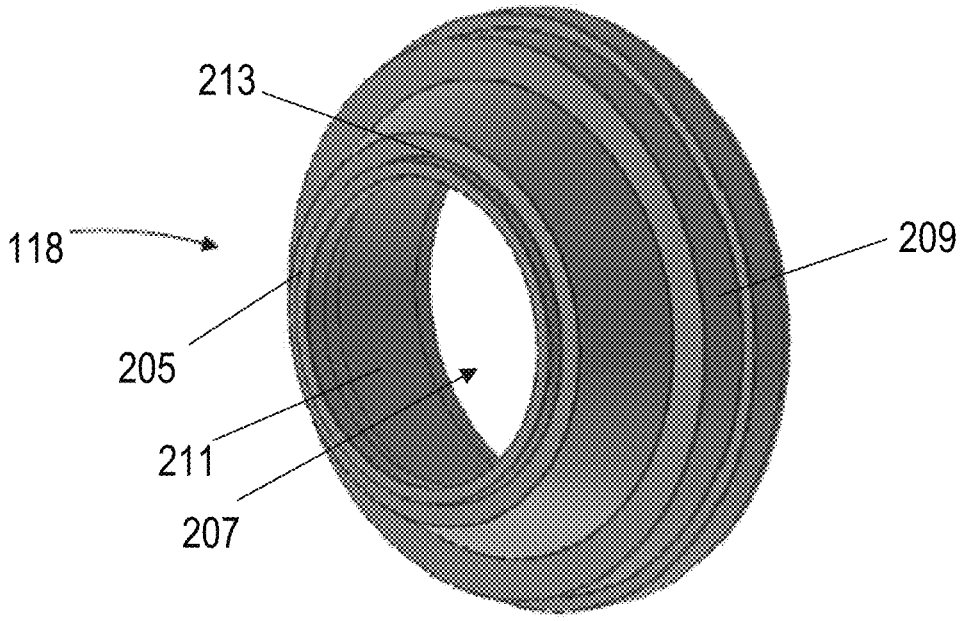
FIG. 18A depicts a rear perspective view of a muzzle brake cap for use in the suppressor of FIG. 1 in accordance with one or more embodiments of the disclosure.
Figure 18B:
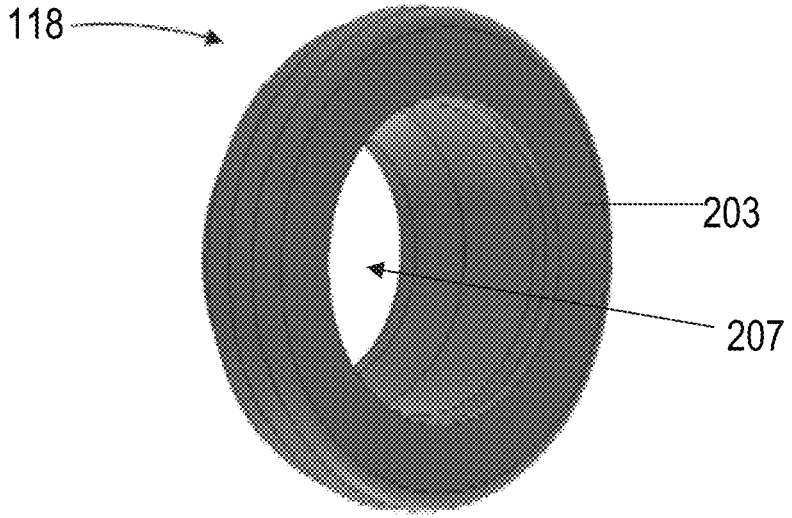
FIG. 18B depicts a front perspective view of the muzzle brake cap for use in the suppressor of FIG. 1 in accordance with one or more embodiments of the disclosure.
Figure 19A:
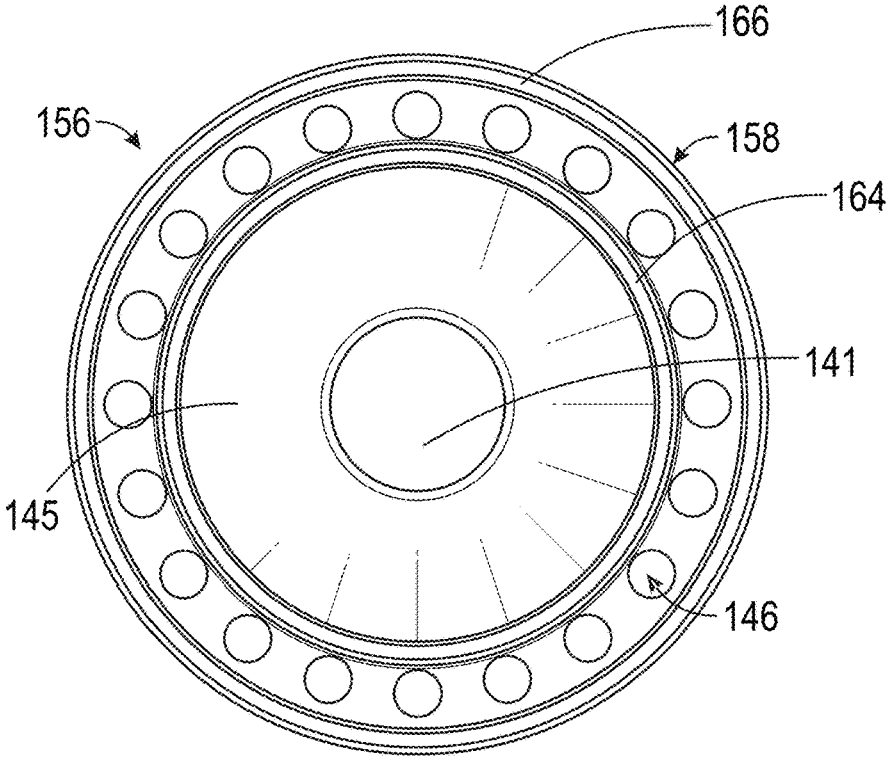
FIG. 19A depicts a front elevation view of an expansion chamber baffle for use in the suppressor of FIG. 1 in accordance with one or more embodiments of the disclosure.
Figure 19B:
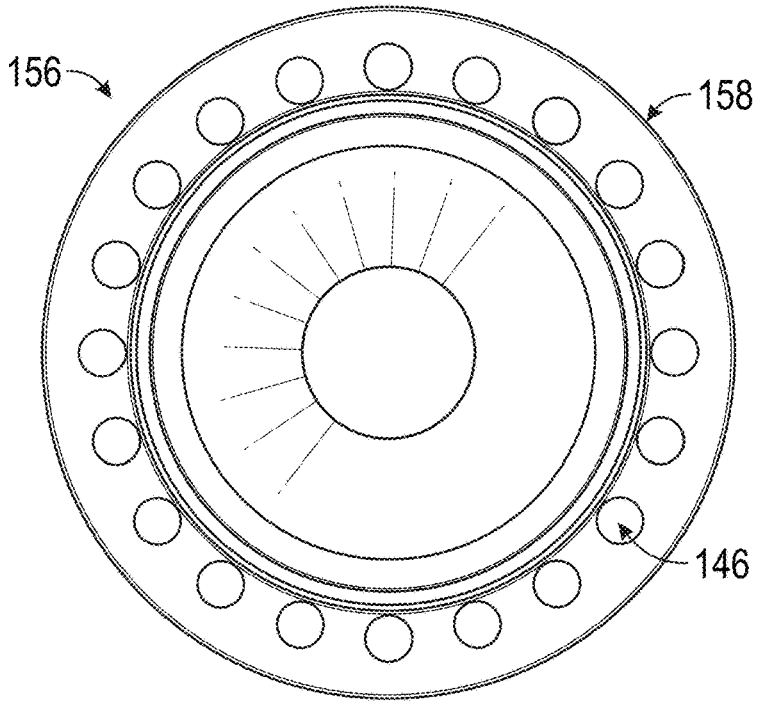
FIG. 19B depicts a rear elevation view of the expansion chamber baffle for use in the suppressor of FIG. 1 in accordance with one or more embodiments of the disclosure.
Figure 19C:
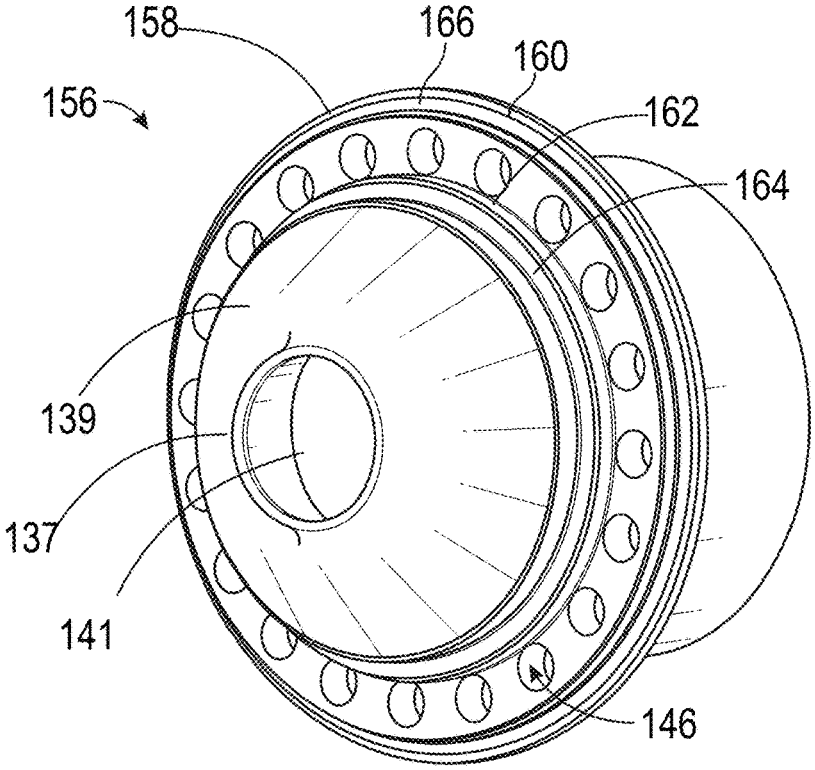
FIG. 19C depicts a front perspective view of the expansion chamber baffle for use in the suppressor of FIG. 1 in accordance with one or more embodiments of the disclosure.
Figure 19D:
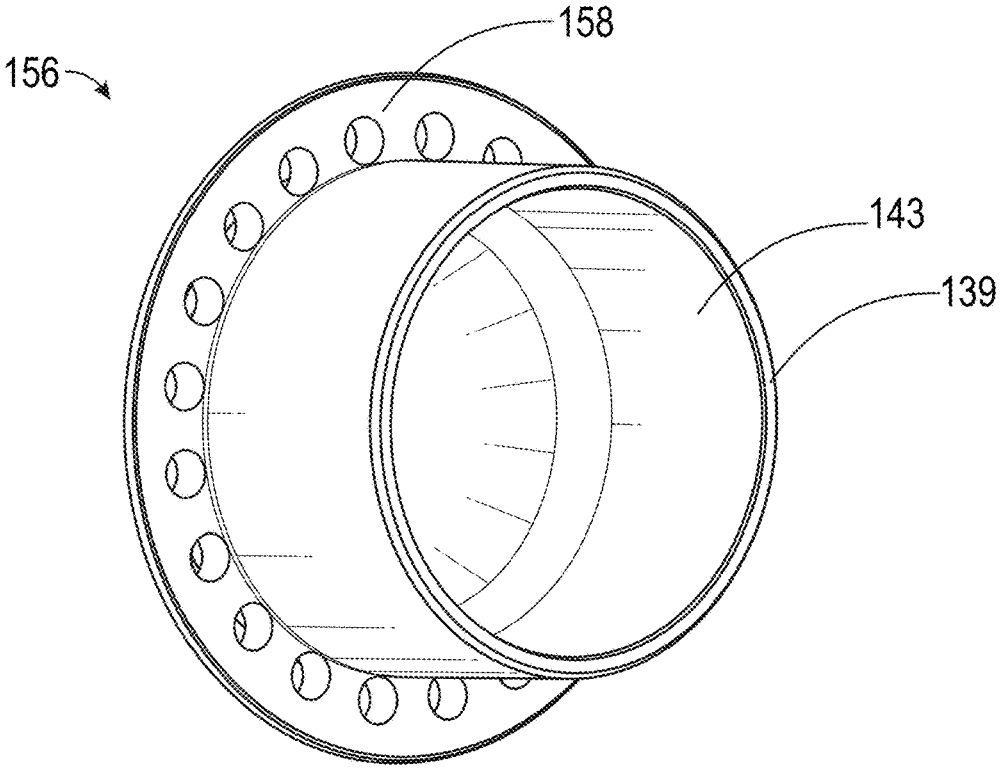
FIG. 19D depicts a rear perspective view of the expansion chamber baffle for use in the suppressor of FIG. 1 in accordance with one or more embodiments of the disclosure.
Figure 20A:
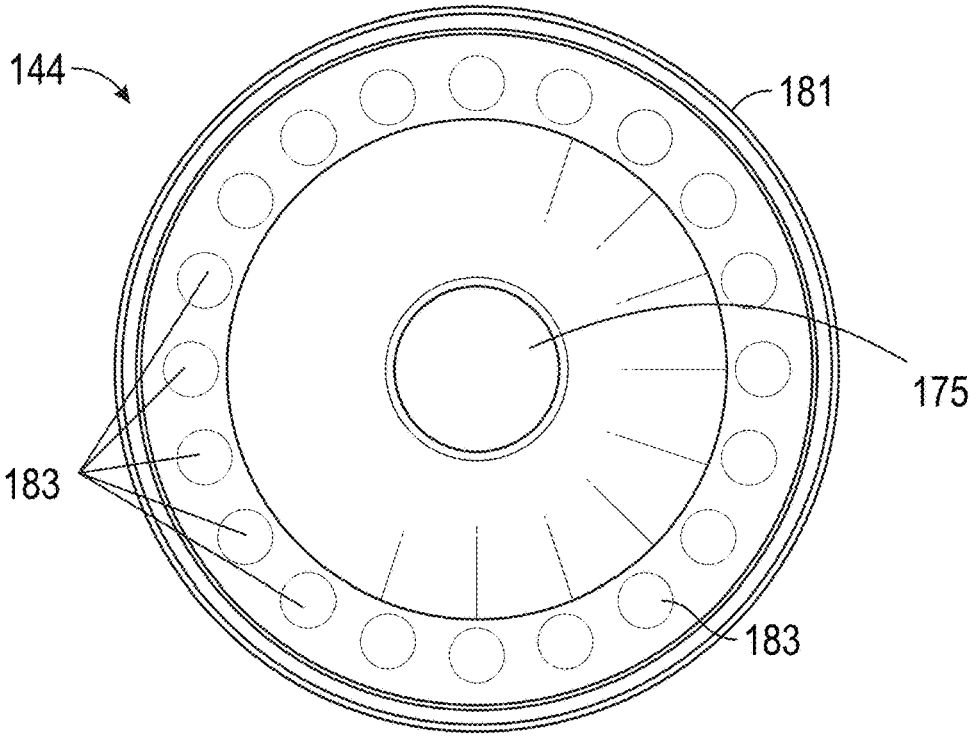
FIG. 20A depicts a front elevation view of a second baffle in a baffle set for use in the suppressor of FIG. 1 in accordance with one or more embodiments of the disclosure.
Figure 20B:
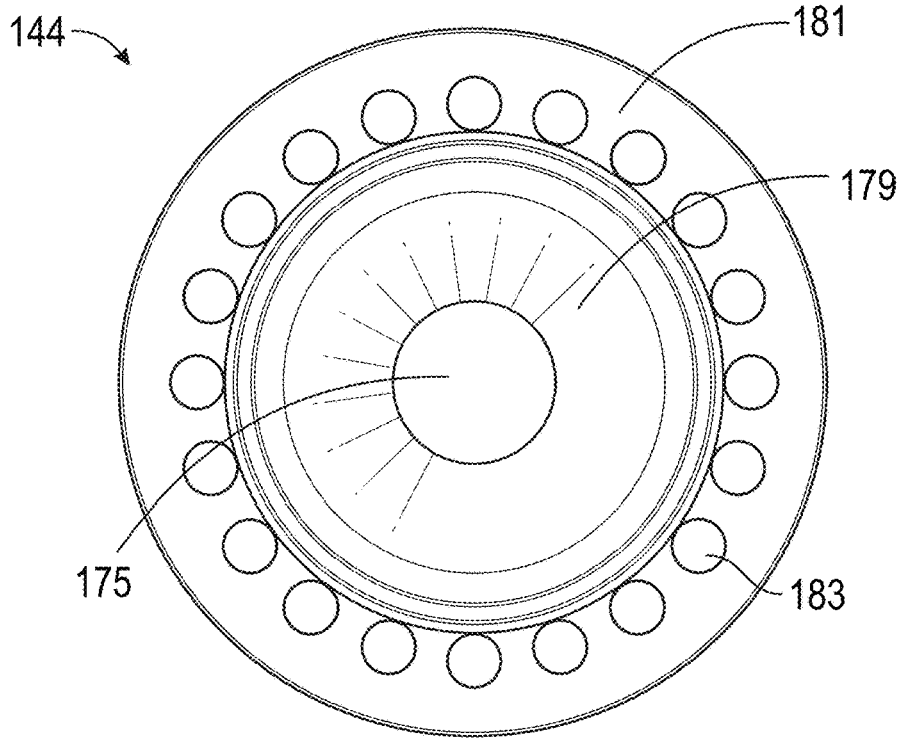
FIG. 20B depicts a rear elevation view of the second baffle in the baffle set for use in the suppressor of FIG. 1 in accordance with one or more embodiments of the disclosure.
Figure 20C:
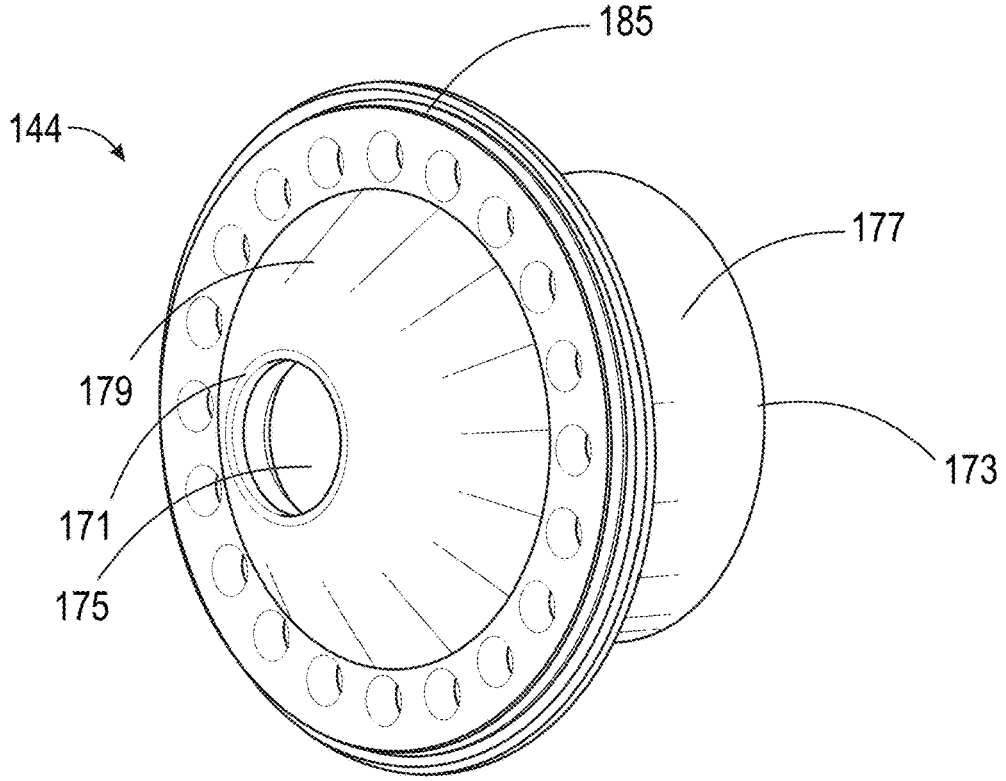
FIG. 20C depicts a front perspective view of the second baffle in the baffle set for use in the suppressor of FIG. 1 in accordance with one or more embodiments of the disclosure.
Figure 20D:
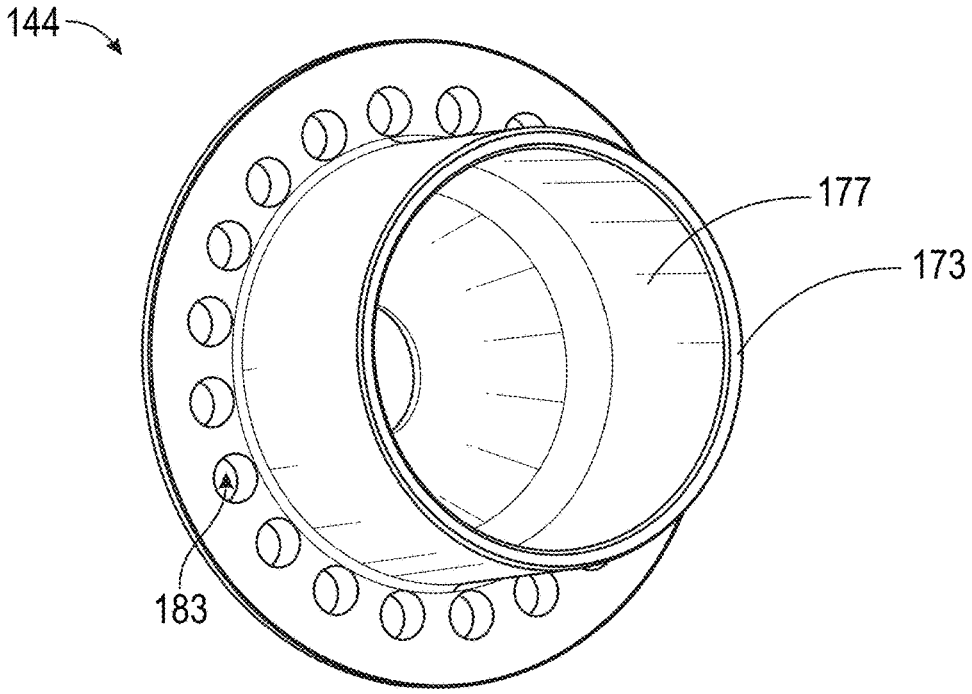
FIG. 20D depicts a rear perspective view of the second baffle in the baffle set for use in the suppressor of FIG. 1 in accordance with one or more embodiments of the disclosure.

The suppressor assembly 100 can also include a muzzle brake 110 and a muzzle brake cap 118. FIGS. 10A-10D provide a perspective and various elevation views of a muzzle brake 110 for use in the suppressor assembly 100 of FIG. 1 in accordance with one or more embodiments of the disclosure. FIGS. 18A-18B provide perspective views of a muzzle brake cap 118 for use in the suppressor assembly 100 of FIG. 1 in accordance with one or more embodiments of the disclosure. Referring now to FIGS. 1-10D and 18A-18B, the muzzle brake 110 can be operably coupled to the external can 102 via a muzzle brake cap 118 along the first end 104 of the outer housing 108. In some examples, both the muzzle brake 110 and the muzzle brake cap 118 include threads (e.g., along an outer surface of the muzzle brake 110 and along an inner surface of the muzzle brake cap 118) to threadably couple the muzzle brake 110 to the muzzle brake cap 118. In other examples, the muzzle brake 110 may snap or otherwise be coupled to the muzzle brake cap 118 in any other way known to those or ordinary skill in the art. In certain examples, all or at least a portion of the muzzle brake 110 is disposed within the channel of the external can 102.

The muzzle brake 110 can include a first end 131, a distal second end 133, and a channel or passageway 135 extending from the first end 131 to the second end 133 through which a projectile may travel. In certain examples, the diameter of the channel 135 is less than the diameter of the passageway or channel of the external can 102. The channel 135 can be axially aligned with the bore 120 along the longitudinal axis 103 and configured to align with the bore of a firearm when the suppressor assembly 100 is coupled to a firearm. The first end 131 may be configured to be removably attached to a muzzle end of a firearm. In certain examples, the first end 131 of the muzzle brake 110 can be threadably coupled to the muzzle end of the barrel of a firearm. For example, the first end 131 can include one or more screw threads along a threaded interior surface 134 of the first end 131 of the muzzle brake 110. The one or more screw threads can be configured to engage and be threadably coupled to a threaded surface on the firearm (e.g., along the muzzle end of the bore of the firearm). In certain example embodiments, the muzzle brake may be configured to attached to firearm bores having a caliber from a .17 HMR to a .300 Win Magnum caliber. In other examples, the muzzle brake 110 may be configured to threadably coupled to firearm bores having larger or smaller calibers.

The muzzle brake 110 can also include the first muzzle chamber 112 and the second muzzle chamber 114. In one example, the second muzzle chamber 114 is positioned axially forward (e.g., in the direction of travel of a projectile from a firearm towards the second end 106) of the first muzzle chamber 112 along the longitudinal axis 103 of the suppressor assembly 100. In certain examples, each of the first muzzle chamber 112 and the second muzzle chamber 114 can have a square or substantially square cross-sectional surface area. In other examples, the cross-sectional surface area of each of the first muzzle chamber 112 and the second muzzle chamber 114 can be any other shape including, but not limited to, triangular, rectangular, circular, or oval.

Each muzzle chamber 112, 114 can include one or more exhaust ports 115A, 115B for fluidicly coupling the respective muzzle chamber 112, 114 to the respective first expansion chamber 122 and second expansion chamber 124. In one example, the at least one first exhaust port 115A can be an opening through an outer perimeter wall of the first muzzle chamber 112 and/or the at least one second exhaust port 115B can be an opening through an outer perimeter wall of the second muzzle chamber 114. Each of the openings can be fluidicly coupled to the channel 135. In certain examples, the first muzzle chamber 112 includes two first exhaust ports 115A that are positioned along opposing lateral sides of the muzzle brake 110 and the longitudinal axis 103, and the second muzzle chamber 114 includes two second exhaust ports 115B that are positioned on opposing lateral sides of the muzzle brake 110 and the longitudinal axis 103.

In some examples, each muzzle chamber 112, 114 can also include a fore end having a fore end wall 128 and an aft end having an aft end wall 130. In certain examples, all or at least a portion of the aft end wall 130 may include one or more knubs 132 disposed on the respective aft end wall 130. For example, each of the aft end walls 130 may include a knub 132 positioned on the aft end wall 130 along the muzzle brake channel 135. In one example, a knub 132 is an outwardly projecting protrusion that extends out from the aft end wall 130 towards the fore end wall 128. Each knub 132 is configured to divert exhaust gas across the aft end and the channel 135, which can be centered through the respective knubs 132. As the projectile passes through the channel 135 of the muzzle brake 110, the exhaust gas impacts the knubs 132 and is directed out of an exhaust port 115A, 115B.

In some examples, the first muzzle chamber 112 is fluidicly coupled with the first expansion chamber 122 via the at least one first exhaust port 115A. Further, the second muzzle chamber 114 is fluidicly coupled with the second expansion chamber 124 via the at least one second exhaust port 115B.

The muzzle brake cap 118 can include a first end 203, a distal second end 205, and a channel or passageway 207 that extends through the muzzle brake cap 118 from the first end 203 to the second end 205 through which a projectile may travel. In certain examples, the diameter of the channel 207 is less than the diameter of the passageway or channel of the external can 102 but greater than the channel 135 of the muzzle brake 110. The channel 207 can also have a first diameter at the first end 203 and a second diameter at the second end 205. In certain examples, the first diameter of the channel 207 is greater than the second diameter of the channel 207. At least a portion of the channel 207 can be axially aligned with the bore 120 along the longitudinal axis 103 and configured to align with the bore of a firearm when the suppressor assembly 100 is coupled to a firearm.

The muzzle brake cap 118 can also include an outer wall 209 that extends axially from the first end 203 to the second end 205 and has a generally conical shape. The second end 205 of the muzzle brake cap 118 can be positioned closer to the second end 106 along the longitudinal axis 103. In certain examples, the muzzle brake cap 118 can be threadably coupled to the external can 102. For example, the muzzle brake cap 118 can include threads along a portion of an outer surface of the outer wall 209 and the external can 102 can include threads along an inner surface that threadably engage with the threads of the muzzle brake cap 118. In other examples, the muzzle brake cap 118 can be coupled to the external can via welding, adhesives, or any other method known to those of ordinary skill in the art. In addition, the muzzle brake cap 118 can also be threadably coupled to the muzzle brake 110. For example, the muzzle brake cap 118 can include threads 211 disposed along an inner surface of the outer wall 209 along the channel 207 that threadably engage with the threads of the muzzle brake 110. In other examples, the muzzle brake cap 118 may be coupled to the muzzle brake 110 to via welding, snap-fit, adhesives or any other coupling method known to those of ordinary skill in the art.

In certain examples, the second end 205 of the muzzle brake cap 118 can be positioned within the channel of the external can 102 and at least a portion of the muzzle brake 110 can extend through the channel 207 of the muzzle brake cap 118. The channel 207 can be fluidicly coupled with the channel of the external can 102 and can be fluidicly coupled with all or a portion of the bore 120. The muzzle brake cap 118 can also include a seat 213 disposed adjacent the second end 205 of the muzzle brake cap 118. In some examples, the seat 213 may be an annular surface (e.g., two flat surfaces creating a 90-degree angle or some other angle) disposed about the circumference of the muzzle brake cap 118. The seat 213 may be configured to abut an inner surface of the outer wall of a first chamber cap 176. In one example, the channel 207 of the muzzle brake cap 118 can be fluidicly coupled to the channel 125 of the first expansion chamber 122 and/or the channel 129 of the second expansion chamber 124.

Figure 14A:
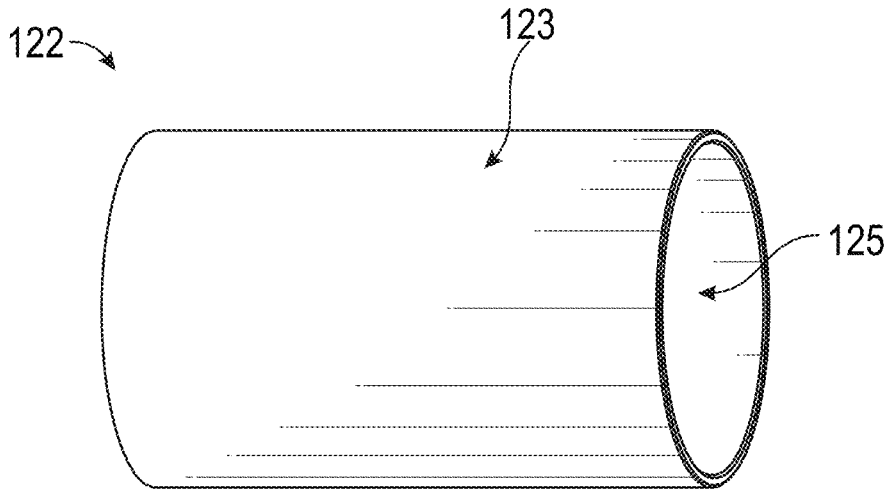
FIG. 14A depicts a perspective view of a first expansion chamber for use in the suppressor of FIG. 1 in accordance with one or more embodiments of the disclosure.
Figure 14B:
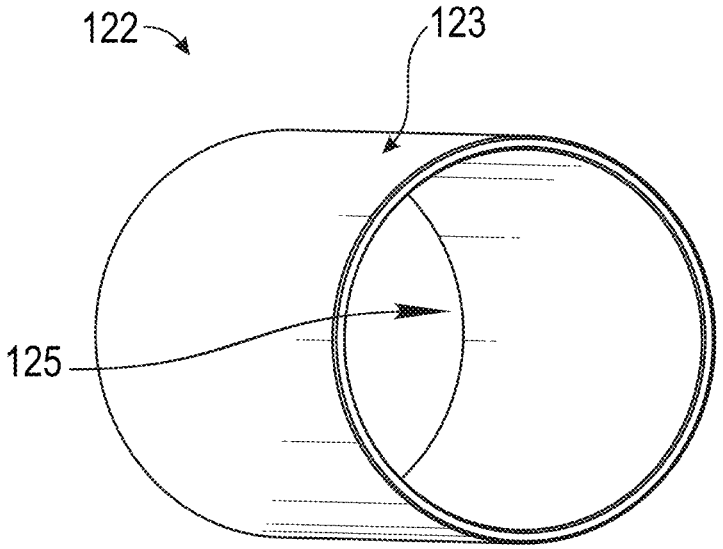
FIG. 14B depicts a front perspective view of the first expansion chamber for use in the suppressor of FIG. 1 in accordance with one or more embodiments of the disclosure.

In some examples, the suppressor assembly 100 also includes a first expansion chamber 122 and a second expansion chamber 124. FIGS. 14A and 14B present perspective views of the first expansion chamber 122 for use in the suppressor of FIG. 1 in accordance with one or more embodiments of the disclosure. Now referring to FIGS. 1-9 and 14, the first expansion chamber 122 can have a cylindrical or substantially cylindrical shape that includes an outer wall 123 that is positioned radially outward of the bore 120 and can extend axially along a portion of the longitudinal axis 103 of the suppressor assembly 100. The first expansion chamber 122 can be positioned within the channel of the external can 102. In certain examples, the first expansion chamber 122 can be hollow with the inner surface of the outer wall 123 defining a passageway or channel 125 that extends from a first end of the first expansion chamber to an opposing second end of the first expansion chamber 122. The channel 125 can have a diameter (defined by an inner surface of the outer wall 123) that is greater than the diameter of the bore 120. The first expansion chamber 122 can be fluidicly coupled to the muzzle brake 110 by one or more exhaust ports 115. In certain example embodiments, at least a portion of the muzzle brake 110 extends into the channel 125 of the first expansion chamber 122 and is disposed within the channel 125. The channel 125 of the first expansion chamber 122 can be a void or volume within the suppressor assembly 100 that is configured to receive and optionally reduce the pressure and temperature of the exhaust gases expelled by a firearm.

Figure 13A:
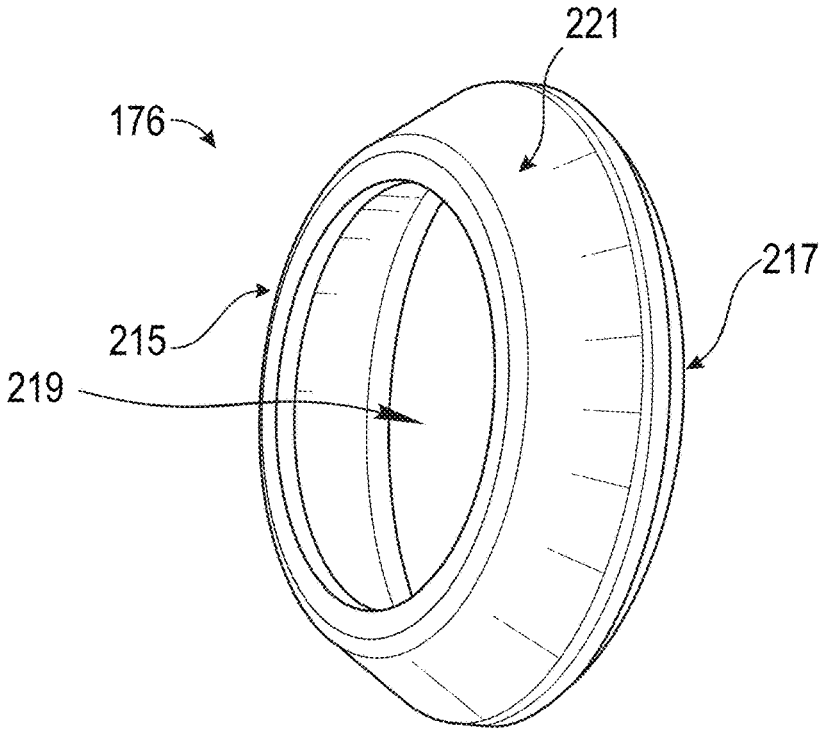
FIG. 13A depicts a front perspective view of a first chamber cap for an expansion chamber in the suppressor of FIG. 1 in accordance with one or more embodiments of the disclosure.
Figure 13B:
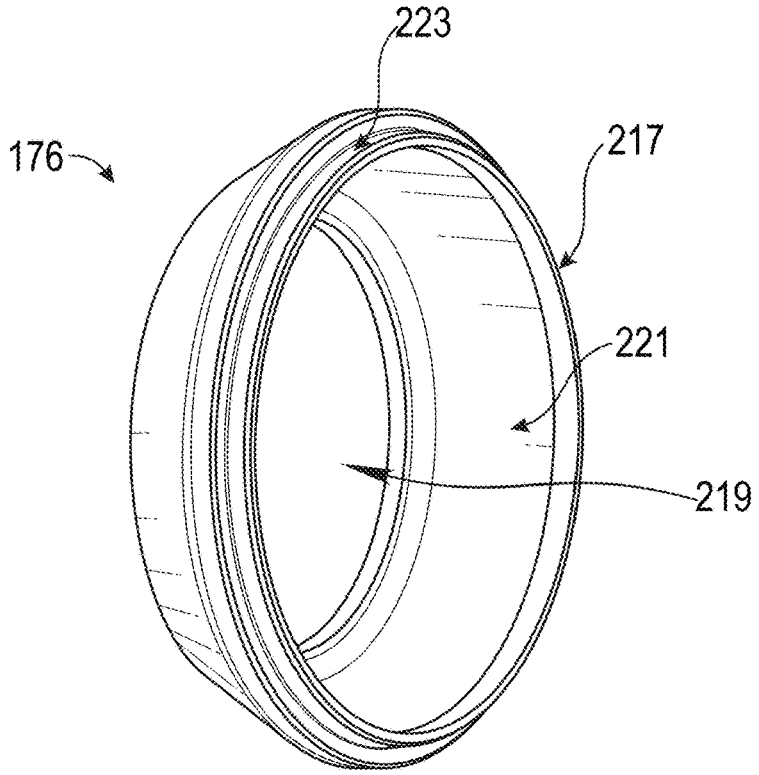
FIG. 13B depicts a rear perspective view of the first chamber cap for the expansion chamber in the suppressor of FIG. 1 in accordance with one or more embodiments of the disclosure.

The suppressor assembly 100 can also include a first chamber cap 176 disposed within the channel of the external can 102. FIGS. 13A-B are perspective views of the first chamber cap 176 for the first expansion chamber 122 for the suppressor of FIG. 1 in accordance with one or more embodiments of the disclosure. Referring now to FIGS. 1-9 and 13A-14B, the example first chamber cap 176 can include a first end 215, a distal second end 217, and a channel or passageway 219 that extends through the first chamber cap 176 from the first end 215 to the second end 217 through which a projectile may travel. In certain examples, the diameter of the channel 219 is less than the diameter of the passageway or channel of the external can 102 but greater than the channel 135 of the muzzle brake 110. The channel 219 can also have a first diameter at the first end 215 and a second diameter at the second end 217. In certain examples, the first diameter of the channel 219 is less than the second diameter of the channel 219. At least a portion of the channel 219 can be axially aligned with the bore 120 along the longitudinal axis 103 and configured to align with the bore of a firearm when the suppressor assembly 100 is coupled to a firearm.

The first chamber cap 176 can also include an outer wall 221 that extends generally axially from the first end 215 to the second end 219 and has a generally conical shape. In one example, the outer wall 221 can include a beveled outer surface. The second end 217 of the first chamber cap 176 can be positioned closer to the second end 106 of the suppressor assembly 100 along the longitudinal axis 103. In certain examples, the first chamber cap 176 can abut the muzzle brake cap 118 along the first end 215 and abut the first expansion chamber 122 along the second end 217.

In certain examples, the first chamber cap 176 can be positioned within the channel of the external can 102 and at least a portion of the muzzle brake 110 can extend through the channel 219 of the first chamber cap 176. The channel 219 can be fluidicly coupled with the channel of the external can 102 and can be fluidicly coupled with all or a portion of the bore 120, the channel 125 of the first expansion chamber 122, and the channel 129 of the second expansion chamber 124. The first chamber cap 176 can also include a seat 223 disposed adjacent the second end 217 of the first chamber cap 176. In some examples, the seat 223 may be an annular surface (e.g., two flat surfaces creating a 90-degree angle or some other angle) disposed about the circumference of the first chamber cap 176. The seat 223 may be configured to abut an inner surface of the outer wall 123 of the first expansion chamber 122 to fixedly or removably couple the first chamber cap 176 to the first expansion chamber 122.

Figure 17:
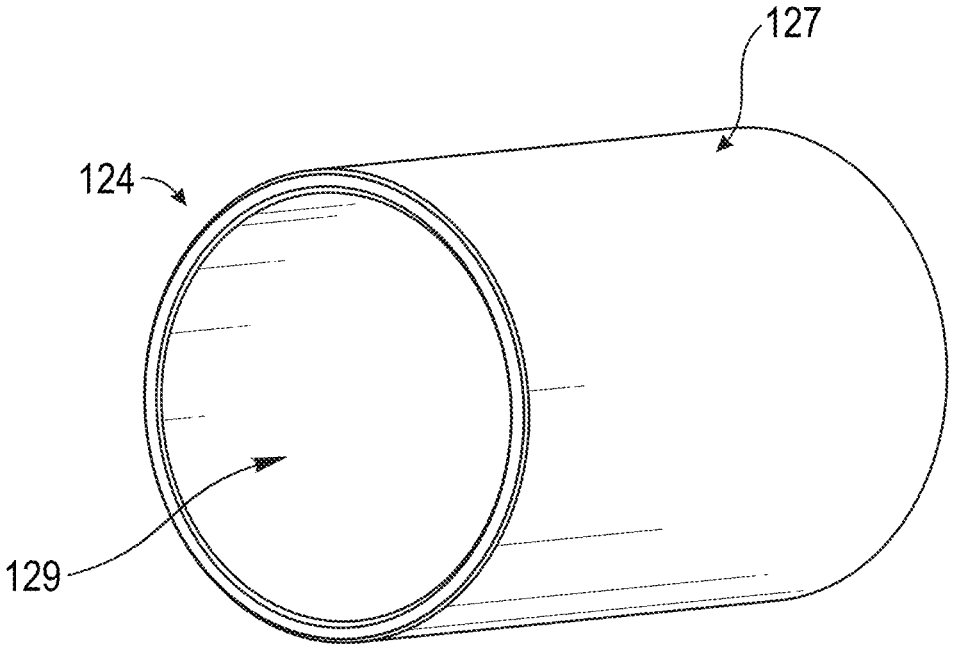
FIG. 17 depicts a perspective view of a second expansion chamber for use in the suppressor of FIG. 1 in accordance with one or more embodiments of the disclosure.

FIG. 17 presents a perspective view of the second expansion chamber 124 for use in the suppressor assembly 100 of FIG. 1 in accordance with one or more embodiments of the disclosure. Now referring to FIGS. 1-9, 14, and 17, the second expansion chamber 124 can have a cylindrical or substantially cylindrical shape that includes an outer wall 127 that is positioned radially outward of the bore 120 and can extend axially along a portion of the longitudinal axis 103 of the suppressor assembly 100. The second expansion chamber 124 can be positioned within the channel of the external can 102. In certain examples, the second expansion chamber 124 can be hollow with the inner surface of the outer wall 127 defining a passageway or channel 129 that extends from a first end of the second expansion chamber 124 to an opposing second end of the second expansion chamber 124. The channel 129 can have a diameter (defined by an inner surface of the outer wall 127) that is greater than the diameter of the bore 120 but less than the diameter of the channel 125 of the first expansion chamber 122. Further, the diameter of the outer wall 123 of the first expansion chamber 122 can be greater than the outer wall 127 of the second expansion chamber 124. In certain examples, all or at least a portion of the second expansion chamber 124 extends into the channel 125 of the first expansion chamber 122 along the longitudinal axis 103 of the suppressor assembly 100 and is disposed within the channel 125. In certain example embodiments, at least a portion of the muzzle brake 110 extends into the channel 129 of the second expansion chamber 124 and is disposed within the channel 129. The second expansion chamber 124 can be fluidicly coupled to the muzzle brake 110 by one or more exhaust ports 115 on the muzzle brake 110. The channel 129 of the second expansion chamber 124 can be a void or volume within the suppressor assembly 100 that is configured to receive and optionally reduce the pressure and temperature of the exhaust gases expelled by a firearm.

In certain examples, the outer wall 123 of the first expansion chamber 122 may be disposed partially about (e.g., circumferentially) all or a portion of the muzzle brake 110 and the second expansion chamber 124 along the longitudinal axis 103. In some examples, the outer wall 127 of the second expansion chamber 124 may be completely or partially disposed about (e.g., circumferentially) all or at least a portion of the muzzle brake 110.

Figure 16:
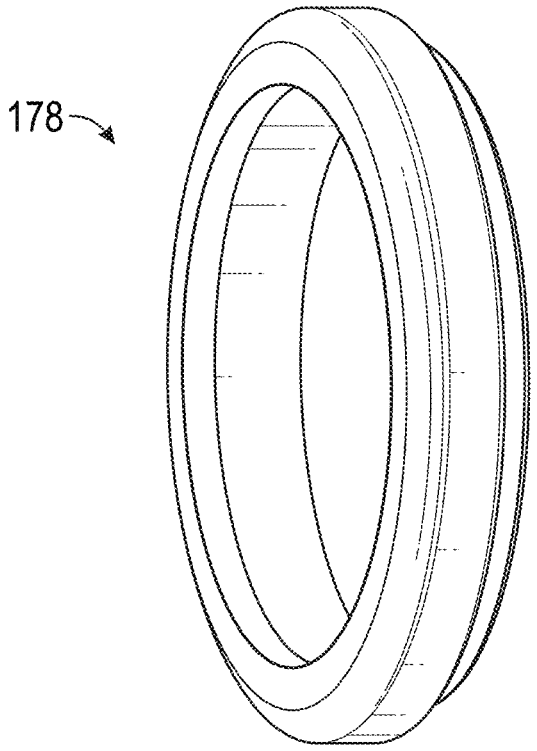
FIG. 16 depicts a perspective view of a second shim of a second expansion chamber for use in the suppressor of FIG. 1 in accordance with one or more embodiments of the disclosure.

The suppressor assembly 100 can also include a shim cap 178 disposed within the channel of the external can 102. FIG. 16 is a perspective view of the shim cap 178 for the second expansion chamber 124 of the suppressor of FIG. 1 in accordance with one or more embodiments of the disclosure. Referring now to FIGS. 1-9, 16, and 17, the example shim cap 178 can include a first end 225, a distal second end 227, and a channel or passageway 229 that extends through the shim cap 178 from the first end 225 to the second end 227 through which a projectile may travel. In certain examples, the diameter of the channel 229 is less than the diameter of the passageway or channel of the external can 102 but greater than the channel 135 of the muzzle brake 110. The channel 229 can also have a first diameter at the first end 225 and a second diameter at the second end 227. In certain examples, the first diameter of the channel 229 is greater than the second diameter of the channel 229. In other examples, the first diameter and the second diameter are the same. At least a portion of the channel 229 can be axially aligned with the bore 120 along the longitudinal axis 103 and configured to align with the bore of a firearm when the suppressor assembly 100 is coupled to a firearm.

The shim cap 178 can also include an outer wall 231 that extends generally axially from the first end 225 to the second end 229 and has a generally cylindrical shape. The second end 227 of the shim cap 178 can be positioned closer to the second end 106 of the suppressor assembly 100 along the longitudinal axis 103. In certain examples, the shim cap 178 can abut the an inner surface of the outer wall 123 of the first expansion chamber 122 along the first end 225 and abut the outer wall 127 of the second expansion chamber 124 along the second end 227.

In certain examples, the shim cap 178 can be positioned within the channel of the external can 102 and at least a portion of the muzzle brake 110 can extend through the channel 229 of the shim cap 178. The channel 229 can be fluidicly coupled with the channel of the external can 102 and can be fluidicly coupled with all or a portion of the bore 120, the channel 125 of the first expansion chamber 122, and the channel 129 of the second expansion chamber 124. The shim cap 178 can also include a seat 233 disposed adjacent the second end 227 of the shim cap 178. In some examples, the seat 233 may be an annular surface (e.g., two flat surfaces creating a 90-degree angle or some other angle) disposed about the circumference of the shim cap 178. The seat 233 may be configured to abut an inner surface of the outer wall 127 of the second expansion chamber 124.

The suppressor assembly 100 can also include an expansion chamber baffle 156. The expansion chamber baffle 156 can be positioned within the channel of the external can 102. FIGS. 19A-19D present various perspective and elevation views of an expansion chamber baffle 156 for use in the suppressor assembly 100 of FIG. 1 in accordance with one or more embodiments of the disclosure. Referring now to FIGS. 1-9 and 19A-19D, in certain examples, the expansion chamber baffle 156 can be positioned axially forward (e.g., in the direction of travel of a projectile from a firearm towards the second end 106) of the first expansion chamber 122 and the second expansion chamber 124 along the longitudinal axis 103 of the suppressor assembly 100. In certain examples, each expansion chamber 122, 124 may be positioned adjacent to and/or abut at least a portion of the expansion chamber baffle 156. For example, FIG. 8 shows the first expansion chamber 122 and the second expansion chamber 124 abutting or contacting portions of the expansion chamber baffle 156. In other examples, the first expansion chamber 122 and the second expansion chamber 124 may be disposed anywhere within the suppressor assembly 100 between the muzzle brake 110 and the endcap 116.

The expansion chamber baffle 156 can include a first end 137, a distal second end 139, and a channel or passageway 141 that extends through the expansion chamber baffle 156 from the first end 137 to the second end 139 through which a projectile may travel. In certain examples, the diameter of the channel 141 is less than the diameter of the passageway or channel of the external can 102. The channel 141 can also have a first diameter at the first end 137 and a second diameter at the second end 139. In certain examples, the first diameter of the channel 141 is less than the second diameter of the channel 141. At least a portion of the channel 141 can be axially aligned with the bore 120 along the longitudinal axis 103 and configured to align with the bore of a firearm when the suppressor assembly 100 is coupled to a firearm.

The expansion chamber baffle 156 can include a first wall 143 that extends axially from the second end 139 of the expansion chamber baffle 156 and has a cylindrical or substantially cylindrical shape. The expansion chamber baffle 156 can also include an arcuate surface 145 disposed along the first end 137 of the expansion chamber baffle 156. The arcuate surface 145 may be disposed about a center axis of the expansion chamber baffle 156 and positioned adjacent to or within the first expansion chamber 122 and/or the second expansion chamber 124. In one example, the arcuate surface 145 is a concave curved surface that extends from a portion that extends in a direction parallel or substantially parallel to the longitudinal axis 103 adjacent the first end 137 to a portion that extends in a direction orthogonal or substantially orthogonal to the longitudinal axis 103 adjacent the flange 158.

In some examples, the expansion chamber baffle 156 can also include a first seat 160 and a second seat 162 disposed about the arcuate surface 145. As used herein, the term "seat" may refer to a ledge configured to receive a complementary shape. For example, the expansion chamber baffle 156 can also include a flange 158 that extends radially outward from and can be positioned between the arcuate surface 145 and the first wall 143 of the expansion chamber baffle 156. The first side of the flange 158 adjacent to the arcuate surface 145 can include a first flange wall 164 having a first circumference. The second side of the flange 158 can include an second flange wall 166 having a second circumference that is greater than the first circumference. The first flange wall 164 may include a first seat 160. In some examples, the first seat 160 may be an outer edge (e.g., two flat surfaces creating a 90-degree angle or some other angle) of the first flange wall 164 adjacent to the arcuate surface. The second flange wall 166 can include a second seat 162. In some examples, the second seat 162 may be an outer edge of the second flange wall 166. The first seat 160 may be configured to engage and abut an inner surface of the outer wall 127 of the second expansion chamber 124, and the second seat 162 may be configured to engage and abut an inner surface of the outer wall 123 of the first expansion chamber 122. The flange 158 can also include one or multiple apertures 146 that extend axially or substantially axially through the flange 158 in a direction parallel or substantially parallel to the longitudinal axis 103 and are positioned radially between the first flange wall 164 and the second flange wall 166. In certain examples, the apertures 146 can be positioned equally or unequally about the circumference of the expansion chamber baffle 156.

In some examples, the channel 125 of the first expansion chamber 122 is fluidicly coupled with the first muzzle chamber 112 of the muzzle brake 110. In this manner, as the projectile fired by the firearm passes through the channel 135 of the first muzzle chamber 112, the exhaust gas may be discharged from the first muzzle chamber 112, through the one or more exhaust ports 115A, and into the channel 125 of the first expansion chamber 122. The exhaust gas directed into the channel 125 of the first expansion chamber 122 may fluidicly pass through the first expansion chamber 122 to be discharge through one or more apertures 146 disposed through a flange 158 of the expansion chamber baffle 156. The exhaust gas may discharge through the apertures 146 in the expansion chamber baffle 156 and into a first dead chamber exhaust duct 168 fluidicly coupled to the one or more apertures 146. In one example, the first dead chamber exhaust duct 168 may be a hollow space disposed between the external can 102 and the outer wall 123 of the first expansion chamber 122. In some examples, the only manner of ingress or egress for exhaust gas for the first dead chamber exhaust duct 168 is through the apertures 146 disposed through the flange 158. In other examples, the exhaust gas may escape through apertures in the external can 102 and/or other apertures within other components described herein.

In some examples, the channel 129 of the second expansion chamber 124 may be fluidicly coupled with the second muzzle chamber 114 of the muzzle brake 110. As the projectile fired from the firearm passes through the channel 135 of the muzzle brake 110 along the second muzzle chamber 114, the exhaust gas may be directed from the second muzzle chamber 114, through the one or more second exhaust ports 115B, into the channel 129 of the second expansion chamber 124. In certain embodiments, the exhaust gas may only escape from the channel 129 of the second expansion chamber 124 either through a vacuum exerted on the second expansion chamber 124 or as the pressure throughout the suppressor assembly 100 works to achieve equilibrium.

The suppressor assembly 100 can also include one or more baffle sets 138, 140. In certain examples, the suppressor assembly 100 can include a first baffle set 138 and a second baffle set 140. In other examples, the suppressor assembly 100 can include just one baffle set or more that two baffle sets. Each baffle set 138, 140 can be positioned within the channel of the external can 102. The first baffle set 138 can be positioned axially forward (e.g., in the direction of travel of a projectile from a firearm towards the second end 106) of the expansion chamber baffle 156 along the longitudinal axis 103 of the suppressor assembly 100. The second baffle set 140 can be positioned axially forward (e.g., in the direction of travel of a projectile from a firearm towards the second end 106) of the first baffle set 138 along the longitudinal axis 103 of the suppressor assembly 100. In certain examples, each baffle set 138, 140 can include a first baffle 142 and a second baffle 144. The second baffle 144 can be positioned axially forward (e.g., in the direction of travel of a projectile from a firearm towards the second end 106) of the first baffle 142 along the longitudinal axis 103 of the suppressor assembly 100 for each of the baffle sets 138, 140 in certain example embodiments.

Figure 12A:
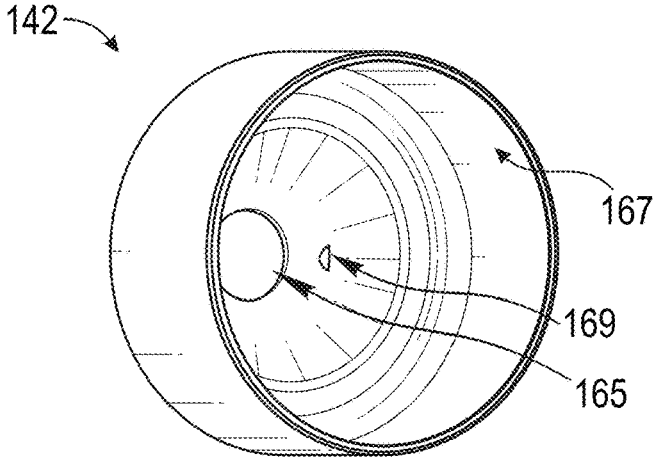
FIG. 12A depicts a rear perspective view of a first baffle in a baffle set for use in the suppressor of FIG. 1 in accordance with one or more embodiments of the disclosure.
Figure 12B:
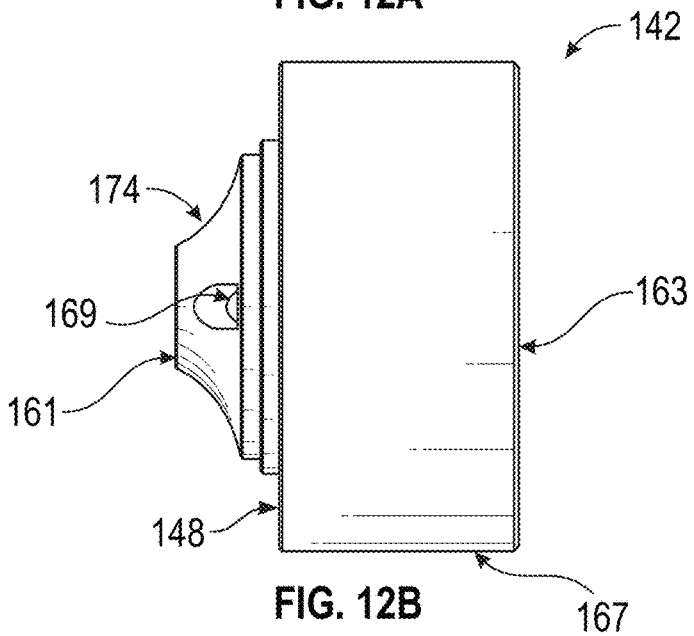
FIG. 12B depicts a side elevation view of the first baffle in a baffle set for use in the suppressor of FIG. 1 in accordance with one or more embodiments of the disclosure.
Figure 12C:
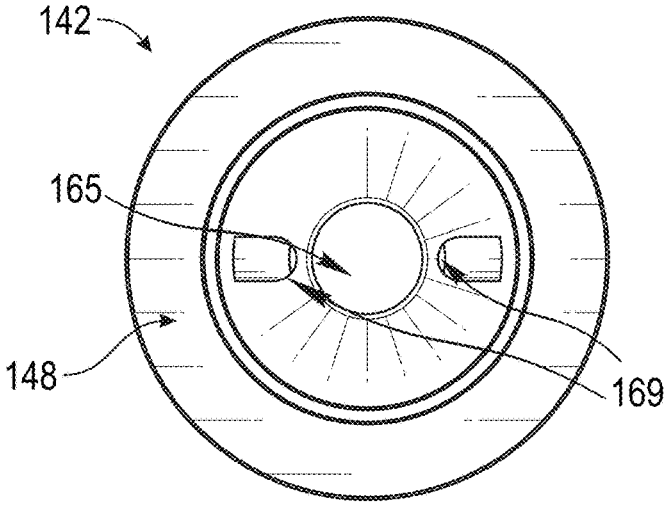
FIG. 12C depicts a top elevation view of the first baffle in the baffle set for use in the suppressor of FIG. 1 in accordance with one or more embodiments of the disclosure.

FIGS. 12A-12C depict various views of a first baffle 142 in a baffle set 138, 140 for the suppressor assembly 100 in accordance with one or more embodiments of the disclosure. Now referring to FIGS. 1-9 and 12A-12C, the first baffle 142 may include a first end 161, a distal second end 163, and a channel or passageway 165 that extends through the first baffle 142 from the first end 161 to the second end 163 through which a projectile may travel. In certain examples, the diameter of the channel 165 is less than the diameter of the passageway or channel of the external can 102. The channel 165 can also have a first diameter at the first end 161 and a second diameter at the second end 163. In certain examples, the first diameter of the channel 165 is less than the second diameter of the channel 165. At least a portion of the channel 165 (e.g., the portion at the first end 161) can be axially aligned with the bore 120 along the longitudinal axis 103 and configured to align with the bore of a firearm when the suppressor assembly 100 is coupled to a firearm.

The first baffle 142 can include a first wall 167 that extends axially from the second end 163 of the first baffle 142 and has a cylindrical or substantially cylindrical shape. The second end 163 of the first baffle 142 can be positioned closer to the second end 106 along the longitudinal axis 103. In certain examples, the second end 163 of the first baffle 142 can abut the second baffle 144 of the baffle set 138, 140. The first end 161 of the first baffle 142 can include an arcuate surface 174 having a leading end (positioned closer to the second end 106) and a trailing end. The arcuate surface 174 can be disposed about a center axis of the first baffle 142, with the center axis aligned with the longitudinal axis 103. The trailing end of the arcuate surface can define an opening to the channel 165 and is fluidicly coupled with the remainder of the bore 120. In certain examples, the arcuate surface 174 can also include one or more additional apertures 169 disposed through the arcuate surface between the leading end and the trailing end and fluidicly coupled to the channel 165. In one example, the trailing end of the arcuate surface 174 has a radius that is less than the radius of the leading end of the arcuate surface 174. In one example, the arcuate surface 174 is a concave curved surface. The trailing end of the arcuate surface 174 (at the first end 161) extends in a direction parallel or substantially parallel to the longitudinal axis 103. The arcuate surface 174 can extend to a portion at the leading end of the arcuate surface that extends in a direction orthogonal or substantially orthogonal to the longitudinal axis 103 adjacent the flange 148.

The first baffle 142 can also include a flange 148. The flange 148 can be disposed between and/or adjacent to the arcuate surface 174 and the first wall 167. The flange 148 can extend about a perimeter of the first baffle 142. In one example, the flange 148 can extend radially out from or adjacent to the leading end of the arcuate surface 174. In this manner, the arcuate surface 174 may extend axially out, and somewhat radially inward, from the surface of the flange 148. In some examples, the flange 148 may be a solid, continuous surface with no apertures disposed therethrough. In other examples, the flange 148 may include apertures (not shown) disposed axially or substantially axially through the flange in a direction parallel or substantially parallel to the longitudinal axis 103. In certain examples, the apertures mentioned herein may be angled with respect to the longitudinal axis 103 to direct exhaust gas generated by a firearm. In one example, the channel 165 of the first baffle 142 of a baffle set 138, 140 may be fluidicly coupled to the channel 141 of the expansion chamber baffle 156 and a channel of the second baffle 144 in the baffle set 138, 140. The channel 165 of the first baffle 142 of another baffle set 138, 140 can be fluidicly coupled to a channel of the second baffle 144 of a first baffle set 138 and a channel of a second baffle 144 of a second baffle set 140.

FIGS. 20A-20D depict various views of a second baffle 144 in a baffle set 138, 140 for the suppressor assembly 100 in accordance with one or more embodiments of the disclosure. Now referring to FIGS. 1-9 and 20A-20D, the second baffle 144 may include a first end 171, a distal second end 173, and a channel or passageway 175 that extends through the second baffle 144 from the first end 171 to the second end 173 through which a projectile may travel. In certain examples, the diameter of the channel 175 is less than the diameter of the passageway or channel of the external can 102. The channel 175 can also have a first diameter at the first end 171 and a second diameter at the second end 173. In certain examples, the first diameter of the channel 175 is less than the second diameter of the channel 175. At least a portion of the channel 175 (e.g., the portion at the first end 171) can be axially aligned with the bore 120 along the longitudinal axis 103 and configured to align with the bore of a firearm when the suppressor assembly 100 is coupled to a firearm.

The second baffle 144 can include a first wall 177 that extends axially from the second end 173 of the second baffle 144 and has a cylindrical or substantially cylindrical shape. The second end 173 of the second baffle 144 can be positioned closer to the second end 106 along the longitudinal axis 103. In certain examples, the second end 173 of the second baffle 144 can abut the first baffle 144 of each of the baffle sets 138, 140. The first end 171 of the second baffle 144 can include an arcuate surface 179 having a leading end (positioned closer to the second end 106) and a trailing end. The arcuate surface 179 can be disposed about a center axis of the second baffle 144, with the center axis aligned with the longitudinal axis 103. The trailing end of the arcuate surface 179 can define an opening to the channel 175 and is fluidicly coupled with the remainder of the bore 120. In one example, the trailing end of the arcuate surface 179 has a radius that is less than the radius of the leading end of the arcuate surface 179. In one example, the arcuate surface 179 is a concave curved surface. The trailing end of the arcuate surface 179 (at the first end 171) extends in a direction parallel or substantially parallel to the longitudinal axis 103. The arcuate surface 179 can extend to a portion at the leading end of the arcuate surface 179 that extends in a direction orthogonal or substantially orthogonal to the longitudinal axis 103 adjacent a flange 181.

The second baffle 144 can also include a flange 181. The flange 181 can be disposed between and/or adjacent to the arcuate surface 179 and the first wall 177. The flange 181 can extend about a perimeter of the second baffle 144. In one example, the flange 181 can extend radially out from or adjacent to the leading end of the arcuate surface 179. In this manner, the arcuate surface 179 may extend axially out, and somewhat radially inward, from the surface of the flange 181.

In certain examples, the flange 181 may include one or more apertures 183 disposed axially or substantially axially through the flange 181 in a direction parallel or substantially parallel to the longitudinal axis 103. In other examples, the one or more apertures 183 mentioned herein may be angled with respect to the longitudinal axis 103 to direct exhaust gas generated by a firearm. The one or more apertures 183 can be positioned radially between the leading end of the arcuate surface 179 and an outer edge of the flange 181. In certain examples, the apertures 183 can be positioned equally or unequally about the circumference of the second baffle 144. In other examples, the flange 181 may be a solid, continuous surface with no apertures disposed therethrough. The second baffle 144 can also include a seat 185 disposed along the flange. In some examples, the seat 185 may be an outer edge (e.g., two flat surfaces creating a 90-degree angle or some other angle) of a first flange wall on the flange 181 adjacent to the arcuate surface 179. For example, the seat 185 can have a diameter that is less than the diameter of the outer edge of the flange 181. The seat 185 may be configured to abut an inner surface of the first wall 167 of a first baffle 142 such that the arcuate surface 179 of the second baffle 144 is disposed within the channel 165 of the first baffle 142. In operation, as the projectile enters each baffle set 138, 140, the exhaust gas discharges through the apertures 183 of the second baffle 144 and into at least one exhaust duct fluidicly coupled to the one or more apertures 183 of the second baffle 144.

In one example, the channel 175 of the second baffle 144 of a first baffle set 138 may be fluidicly coupled to the channel 165 of the first baffle 142 of the first baffle set 138 and a channel 165 of the first baffle 142 of the second baffle set 140. Further, the channel 175 of the second baffle 144 of a second baffle set 140 may be fluidicly coupled to the channel 165 of the first baffle 142 of the second baffle set 140 and a channel of an endcap baffle 154.

The first baffle set 138 and the second baffle set 140 can also include at least one exhaust duct 150 disposed between the second baffle 144 of the first baffle set 138 and the first baffle 142 of the second baffle set 140. In certain examples, the at least one exhaust duct 150 is fluidicly coupled to the one or more apertures 183 that axially extend through the flange 181 of the second baffle 144. In this configuration, as the projectile passes through the first baffle 142, the exhaust gas impacts along the arcuate surface 179 of the second baffle 144 and at least a portion of the exhaust gas is directed through at least one of the one or more apertures 183 disposed through the flange 181 of the second baffle 144, and the exhaust gas is further directed into the at least one exhaust duct 150 fluidicly coupled thereto.

Figure 15A:
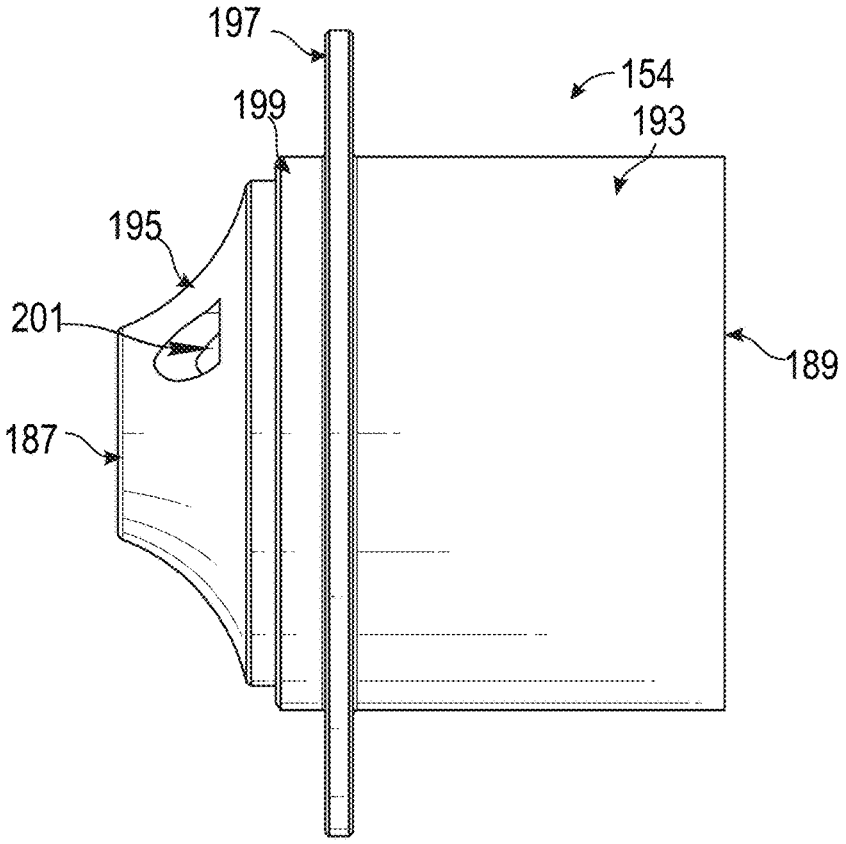
FIG. 15A depicts a side elevation view of an endcap baffle for use in the suppressor of FIG. 1 in accordance with one or more embodiments of the disclosure.
Figure 15B:
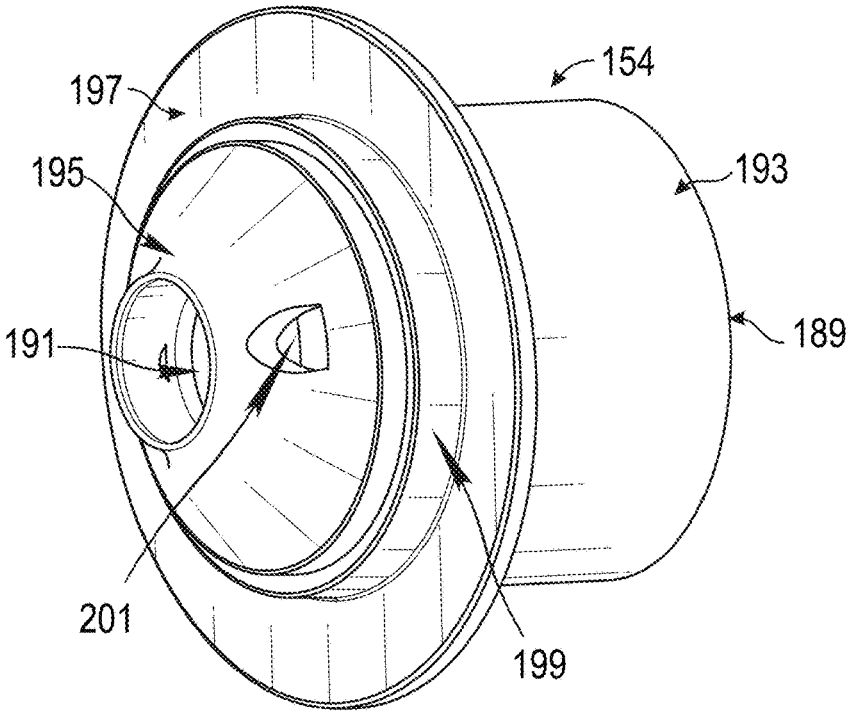
FIG. 15B depicts a front perspective view of the endcap baffle for use in the suppressor of FIG. 1 in accordance with one or more embodiments of the disclosure.

The suppressor assembly 100 can also include an endcap baffle 154. FIGS. 15A-15B depict a side and perspective view of the endcap baffle 154 for use in the suppressor assembly 100 in accordance with one or more embodiments of the disclosure. Now referring to FIGS. 1-9 and 15A-15B, the endcap baffle 154 may include a first end 187, a distal second end 189, and a channel or passageway 191 that extends through the endcap baffle 154 from the first end 187 to the second end 189 through which a projectile may travel. In certain examples, the diameter of the channel 191 is less than the diameter of the passageway or channel of the external can 102. The channel 191 can also have a first diameter at the first end 187 and a second diameter at the second end 189. In certain examples, the first diameter of the channel 191 is less than the second diameter of the channel 191. At least a portion of the channel 191 (e.g., the portion at the first end 187) can be axially aligned with the bore 120 along the longitudinal axis 103 and configured to align with the bore of a firearm when the suppressor assembly 100 is coupled to a firearm.

The endcap baffle 154 can include a first wall 193 that extends axially from the second end 189 of the endcap baffle 154 and has a cylindrical or substantially cylindrical shape. The second end 189 of the endcap baffle 154 can be positioned closer to the second end 106 along the longitudinal axis 103. In certain examples, the first end 187 of the endcap baffle 154 and be positioned within the channel 175 of the second baffle 144 in the second baffle set 140 and the second end 189 of the endcap baffle 154 can abut the endcap 116 (e.g., the inner surface of the first wall 193 can receive and abut a seat on the endcap 116.

The first end 187 of the endcap baffle 154 can include an arcuate surface 195 having a leading end (positioned closer to the second end 189) and a trailing end (positioned at the first end 187). The arcuate surface 195 can be disposed about a center axis of the endcap baffle 154, with the center axis aligned with the longitudinal axis 103. The trailing end of the arcuate surface 195 can define an opening to the channel 191 and is fluidicly coupled with the remainder of the bore 120. In one example, the trailing end of the arcuate surface 195 has a radius that is less than the radius of the leading end of the arcuate surface 195. In one example, the arcuate surface 195 is a concave curved surface. The trailing end of the arcuate surface 195 (at the first end 187) extends in a direction parallel or substantially parallel to the longitudinal axis 103. The arcuate surface 195 can extend to a portion at the leading end of the arcuate surface 195 that extends in a direction orthogonal or substantially orthogonal to the longitudinal axis 103 adjacent a flange 197. In certain examples, the arcuate surface 195 can also include one or more additional apertures 201 disposed through the arcuate surface 195 between the leading end and the trailing end and fluidicly coupled to the channel 191.

The endcap baffle 154 can also include a flange 197. The flange 197 can be disposed between and/or adjacent to the arcuate surface 195 and the first wall 193. The flange 197 can extend about a perimeter of the endcap baffle 154. In one example, the flange 197 can extend radially out from or adjacent to the leading end of the arcuate surface 195. In this manner, the arcuate surface 195 may extend axially out, and somewhat radially inward, from the surface of the flange 197.

In certain examples, the flange 197 may be a solid, continuous surface with no apertures disposed therethrough. In other examples, the flange 197 may include one or more apertures (not shown but substantially the same as the apertures 183 of the second baffle 144 of FIGS. 20A-20D) disposed axially or substantially axially through the flange 181 in a direction parallel or substantially parallel to the longitudinal axis 103. In other examples, the one or more apertures mentioned herein may be angled with respect to the longitudinal axis 103 to direct exhaust gas generated by a firearm. The one or more apertures can be positioned radially between the leading end of the arcuate surface 195 and an outer edge of the flange 197. In certain examples, the apertures can be positioned equally or unequally about the circumference of the endcap baffle 154.

In certain embodiments, the external can 102, the endcap 116, the solid surface of the endcap baffle 154, and the first wall 193 of the endcap baffle 154 may define a second dead chamber exhaust duct 170 within the external can 102 that is fluidicly coupled to the one or more apertures of the endcap baffle 154 and/or the endcap channels 172 of the endcap 116. As a projectile fired from the firearm passes through the endcap baffle 154, the exhaust gas may be directed into the endcap channel 172. The endcap channel 172 may cause the exhaust gas to be directed into the second dead chamber exhaust duct 170. In some examples, the exhaust gas within the second dead chamber exhaust duct 170 can escape from within the second dead chamber exhaust duct 172 when a vacuum is applied therein or the external can 102 adjusts to an equilibrium pressure.

The endcap baffle 154 can also include a seat 199 disposed along the flange 197. In some examples, the seat 199 may be an outer edge (e.g., two flat surfaces creating a 90-degree angle or some other angle) of a first flange wall on the flange 197 adjacent to the arcuate surface 195. For example, the seat 199 can have a diameter that is less than the diameter of the outer edge of the flange 197. The seat 199 may be configured to abut an inner surface of the first wall 177 of a second baffle 144 of the second baffle set 140 such that the arcuate surface 195 of the endcap baffle 154 is disposed within the channel 175 of the second baffle 144. In one example, the channel 191 of the endcap baffle 154 may be fluidicly coupled to the channel 175 of the second baffle 144 of the second baffle set 140 and a channel 117 of the endcap 116.

Each of the components (e.g., the first expansion chamber 122, the second expansion chamber 124, the baffles, etc.) may be contained within the external can 102 between the first end 104 and the second end 106. In some embodiments, the exhaust gas may discharge into a first dead chamber exhaust duct 168. The exhaust gas may follow the path of the projectile through the bore 120 and be discharged into a first baffle set 138 or a second baffle set 140. In some examples, the exhaust gas may discharge through one or more apertures 146 in the second baffle of each baffle set and into at least one exhaust duct 150 between the first baffle set 138 and the second baffle set 140. Towards the distal end 106 of the suppressor assembly 100, the exhaust gas may be directed into a second dead chamber exhaust duct 170 via one or more endcap channels 172.

Although certain suppressor features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents. Likewise, while certain methodologies for directed exhaust through a suppressor are disclosed herein, the disclosed methods are not limited to the particular order of the steps in the methods described herein. Instead, one or more of the steps of one or more of the methodologies described herein may be in a different order or may not be performed at all according to some embodiments. Further, additional steps may also be completed at any point during the methods of directing exhaust through the suppressor assembly as described herein.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or methods are in any way required for one or more implementations or that these features, elements, and/or methods are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A suppressor assembly, comprising:

an external can comprising an outer housing having a first end and a distal second end;

a muzzle brake operably coupled to the external can, the muzzle brake defining a first muzzle chamber and a second muzzle chamber;

wherein the external can comprises:

a bore extending through the external can from the first end to the second end;

a first expansion chamber defined at least partially by a first outer wall, wherein a first portion of the muzzle brake extends into the first expansion chamber, wherein the first expansion chamber is configured to directly accept first exhaust gases from the first muzzle chamber, and is further configured so that the first exhaust gases pass from the first expansion chamber to a dead chamber exhaust duct through one or more apertures in an expansion chamber baffle, wherein the dead chamber exhaust duct is at least partially defined by the outer housing of the external can and the first outer wall of the first expansion chamber;

a second expansion chamber defined at least partially by a second outer wall, wherein a second portion of the muzzle brake extends into the second expansion chamber, wherein the second expansion chamber is configured to directly accept second exhaust gases from the second muzzle chamber, and is further configured so that the second exhaust gases pass from the second expansion chamber through a channel in the expansion chamber baffle;

a plurality of baffles disposed within the outer housing of the external can between the expansion chamber baffle and the second end of the external can, wherein the first expansion chamber is separate from the second expansion chamber, and wherein the second expansion chamber is at least partially disposed within the first expansion chamber, and the first expansion chamber is at least partially disposed within the dead chamber exhaust duct.

2. The suppressor assembly of claim 1, wherein at least a portion of the first portion of the muzzle brake and the second portion of the muzzle brake overlap.

3. The suppressor assembly of claim 1, further comprising:

an endcap disposed along the second end of the external can, the endcap comprising:

a plurality of raised walls extending axially from a surface of the endcap; and a plurality of endcap channels defined by the plurality of raised walls;

an endcap baffle disposed adjacent the endcap and comprising an endcap flange extending radially out from a wall of the endcap baffle; and a second dead chamber exhaust duct disposed between the tubular body, the endcap baffle, and the endcap, wherein the second dead chamber exhaust duct is fluidicly coupled to the plurality of endcap channels.

4. The suppressor assembly of claim 1, wherein each of the first muzzle chamber and the second muzzle chamber comprises:

a fore end wall;

an aft end wall; and a knub disposed on the aft end wall, wherein the knub extends axially out from the aft end wall.

5. The suppressor assembly of claim 1, wherein the plurality of baffles comprises:

a first baffle set; and a second baffle set, wherein each of the first baffle set and the second baffle set comprises a first baffle abutting a second baffle.

6. The suppressor assembly of claim 5, wherein each of the first baffle and the second baffle comprises:

a first baffle end;

a second baffle end;

a first wall extending axially from the second baffle end towards the first baffle end;

an arcuate surface extending from the first baffle end towards the second baffle end; and a first baffle flange extending radially outward and disposed between the first wall and the arcuate surface;

wherein the first baffle flange for the second baffle comprises a plurality of first baffle flange apertures extending axially through the first baffle flange and arranged about a circumference of the second baffle.

7. The suppressor assembly of claim 6, further comprising:

at least one exhaust duct between the second baffle of the first baffle set and the first baffle of the second baffle set, wherein the at least one exhaust duct is fluidicly coupled to plurality of first baffle flange apertures in the first baffle flange of the second baffle.

8. The suppressor assembly of claim 5, wherein the expansion chamber baffle further comprises:

a first baffle end;

a distal second baffle end;

a first wall extending axially from the second baffle end towards the first baffle end;

an arcuate surface extending from the first baffle end towards the second baffle end; and an expansion chamber flange extending radially outward and disposed between the first wall and the arcuate surface;

wherein at least a portion of the first dead chamber exhaust duct is disposed between an inner surface of the tubular body and an outer surface of the first expansion chamber.

9. The suppressor assembly of claim 8, wherein the expansion chamber baffle further comprises:

a first seat disposed along the expansion chamber flange and configured to engage an inner surface of the first expansion chamber; and a second seat disposed along the expansion chamber flange and configured to engage an inner surface of the second expansion chamber.

10. A suppressor assembly, comprising:

an external can comprising a first tubular body having a first end and a distal second end;

a muzzle brake operably coupled to the first end of the tubular body and comprising a first muzzle chamber and a second muzzle chamber;

a first expansion chamber comprising a second tubular body defining a first channel fluidicly coupled to the first muzzle chamber;

a second expansion chamber comprising a third tubular body defining a second channel fluidicly coupled to the second muzzle chamber;

an endcap coupled to the second end of the tubular body;

a plurality of baffles disposed within the tubular body and comprising:

at least a first baffle set and a second baffle set, wherein each of the first baffle set and the second baffle set comprises a first baffle abutting a second baffle, the second baffle comprising a radially extending second baffle flange comprising a plurality of second baffle flange apertures disposed through the second baffle flange; and an endcap baffle disposed adjacent the endcap;

a dead chamber exhaust duct disposed between the endcap and the endcap baffle.

11. The suppressor assembly of claim 10, further comprising at least one exhaust duct disposed between the second baffle of the first baffle set and the first baffle of the second baffle set.

12. The suppressor assembly of claim 11, wherein the at least one exhaust duct is fluidicly coupled to the plurality of second baffle flange apertures disposed through the second baffle flange of the second baffle.

13. The suppressor assembly of claim 10, wherein at least a portion of the second expansion chamber is disposed within the first channel of the first expansion chamber.

14. The suppressor assembly of claim 10, further comprising:

a first dead chamber exhaust duct, at least a portion of the first dead chamber exhaust duct disposed between an inner surface of the tubular body and an outer surface of the second tubular body;

wherein the plurality of baffles further comprises:

an expansion chamber baffle disposed adjacent the first expansion chamber, the expansion chamber baffle comprising:

a first baffle end;

a distal second baffle end; and a radially extending expansion chamber flange comprising a plurality of expansion chamber flange apertures disposed through the expansion chamber flange;

wherein the first dead chamber exhaust duct is fluidicly coupled to the plurality of expansion chamber flange apertures.

15. The suppressor assembly of claim 10, wherein each of the first muzzle chamber and the second muzzle chamber comprises:

a fore end wall;

an aft end wall; and a knub disposed on each aft end wall and extending axially toward the fore end wall of the respective first muzzle chamber or second muzzle chamber.

16. The suppressor assembly of claim 15, wherein the first muzzle chamber comprises at least one first exhaust port disposed through an outer wall of the muzzle brake and fluidicly coupling the first muzzle chamber to the first expansion chamber, and wherein the second muzzle chamber comprises at least one second exhaust port disposed through the outer wall of the muzzle brake and fluidicly coupling the second muzzle chamber to the second expansion chamber.

17. An apparatus comprising:

a firearm;

a suppressor assembly removably coupled to the firearm and comprising:

an external can comprising a tubular body having a first end and a distal second end;

a muzzle brake operably coupled to the external can and the firearm, the muzzle brake comprising a first muzzle chamber and a second muzzle chamber aligned axially along a longitudinal axis of the external can;

a bore extending through external can from the first end to the second end along the longitudinal axis;

a first expansion chamber disposed about at least a first portion of the muzzle brake, the first expansion chamber fluidicly coupled to the first muzzle chamber, wherein the first expansion chamber is configured to directly accept exhaust gases from the first muzzle chamber, and is further configured to transmit the exhaust gases from the first muzzle chamber to a dead chamber exhaust duct through one or more apertures in an expansion chamber baffle, the dead chamber exhaust duct disposed about at least a portion of the first expansion chamber;

a second expansion chamber disposed at least partially within the first expansion chamber and about at least a second portion of the muzzle brake, the second expansion chamber comprising a second channel fluidicly coupled to the second muzzle chamber, wherein the second expansion chamber is configured to directly accept exhaust gases that are expelled through the second portion of the muzzle brake; and a plurality of baffles disposed within the tubular body of the external can between the second expansion chamber and the second end of the external can, wherein the first expansion chamber is separate from the second expansion chamber.

18. The apparatus of claim 17, wherein the plurality of baffles comprises:

a first baffle set; and a second baffle set, wherein each of the first baffle set and the second baffle set comprises a first baffle abutting a second baffle;

wherein each of the first baffle and the second baffle comprises:

a first baffle end;

a second baffle end;

an arcuate surface extending from the first baffle end towards the second baffle end; and a second baffle flange extending radially outward and disposed adjacent the arcuate surface;

wherein the second baffle flange for the second baffle comprises a plurality of second baffle flange apertures extending axially through the second baffle flange and arranged about a circumference of the second baffle.

19. The suppressor assembly of claim 1, further comprising a shim cap disposed within the external can abutting the second outer wall and configured to couple the second outer wall to the muzzle brake.

20. The suppressor assembly of claim 10, further comprising a shim cap disposed within the external can abutting the third tubular body and configured to couple the third tubular body to the muzzle brake.

* * * * *